US007086647B2

(12) United States Patent
Novak

(10) Patent No.: US 7,086,647 B2
(45) Date of Patent: Aug. 8, 2006

(54) TRUCKING BOARD GAME APPARATUS AND METHOD

(76) Inventor: Greg J. Novak, 1646 Burke Ave. East, Maplewood, MN (US) 55109

( * ) Notice: Subject to any disclaimer, the term of this patent is extended or adjusted under 35 U.S.C. 154(b) by 32 days.

(21) Appl. No.: 10/357,976

(22) Filed: Feb. 4, 2003

(65) Prior Publication Data

US 2004/0041345 A1 Mar. 4, 2004

Related U.S. Application Data

(60) Provisional application No. 60/354,532, filed on Feb. 5, 2002.

(51) Int. Cl.
*A63F 3/00* (2006.01)

(52) U.S. Cl. ..... 273/252; 273/256; 273/278

(58) Field of Classification Search ..... 273/252, 273/256, 278, 254, 243, 246
See application file for complete search history.

(56) References Cited

U.S. PATENT DOCUMENTS 4,067,579 A * 1/1978 Boofer ..... 273/254
4,109,917 A * 8/1978 Hatcher ..... 273/254
4,426,084 A * 1/1984 Michel ..... 273/254
4,456,260 A * 6/1984 Hilton ..... 273/256
4,466,515 A * 8/1984 D'Aurora et al. ..... 273/256
4,535,994 A * 8/1985 Cowan ..... 273/256
4,643,430 A * 2/1987 D'Aloia ..... 273/252
4,890,842 A * 1/1990 Plange ..... 273/246
5,439,229 A * 8/1995 Kaiser ..... 273/256
5,456,473 A * 10/1995 Whitney ..... 273/256
5,673,915 A * 10/1997 Shalders ..... 273/256
5,992,852 A 11/1999 Brooks et al.

OTHER PUBLICATIONS

Ex.Parte Breslow 192 USPQ 431.*

* cited by examiner

*Primary Examiner*—Vishu K. Mendiratta

(57) ABSTRACT

A method for playing a game related to trucking where the player is one or more of a truck driver, a federal or state official regulating the truck driver, or owner of a 1) service center, 2) insurance company, 3) truck stop having a restaurant, 4) produce broker, shipper, 5) casino, 6) tow service, 7) truck payment center, 8) tire service, and/or 9) farmers' market. The method includes the step of winning the game by building a fleet of trucks of a predetermined number. The game board apparatus includes a course having a number of spaces, game truck or markers for moving along the spaces, bills representing money, chance cards, and a chance element.

38 Claims, 24 Drawing Sheets

TRUCKING BOARD GAME APPARATUS AND METHOD

This case claims the benefit under 35 U.S.C. 119(e) of U.S. Provisional Patent Application No. 60/354,532 filed Feb. 5, 2002.

FIELD OF THE INVENTION

The present invention relates generally to an apparatus and method for playing a board game, particularly to an apparatus and method for playing a trucking board game, and specifically to an apparatus and method for playing a trucking board game where the player is a hybrid of a trucker, state or federal official, and/or entrepreneur.

BACKGROUND OF THE INVENTION

Truckers keep America rolling. About 90% of all freight is carried by trucks. Truckers haul food, clothing, building supplies, newspaper, soda pop, gasoline, shampoo, lunch bags, aspirin, flowers, hot dogs, perhaps each of the products listed under the 72,000 product headings of the Thomas Register®, and probably more. 75% of the communities in America are serviced only by the truck, with none of these communities receiving freight by planes, trains or barges or by any other means of transportation. Indeed, when the trucking industry hits rough times, economists use such as a barometer for predicting bad times for America as a whole.

Most of the trucking companies in the United States are relatively small. For example, 80% of the truck companies in the United States have 20 or fewer trucks in their fleets. With a relatively low number of trucks, there is little room for cost overruns. Increases in diesel fuel, taxes, insurance rates and other costs hit the little man hard.

Even though the relatively large trucking companies too suffer in hard times, such large trucking companies can weather the storm better. For example, large trucking companies have established clients who themselves are often Fortune 500 companies.

Truckers themselves, though they may stop driving, may never leave the trucking industry. A few become an owner of a truck, hire a driver to drive the truck, and over time own a fleet of trucks. Others open a truck stop or a restaurant at a truck stop. Others work for truck insurance agencies or go to work for federal or state authorities regulating trucks. Still others work in sales or service.

SUMMARY OF THE INVENTION

A feature of the present invention is the provision in method for playing a board game related to the trucking industry, of providing a course having a number of spaces, game trucks or markers for moving along the course, an initial amount of money for each of the set of players, a direction in at least one space for taking money away from a player, a direction in at least one space for reception of money by a player, and a chance element having a first operator for determining how many spaces the game trucks move and a second operator for determining how many game trucks a player may purchase.

Another feature of the present invention is the provision in a method for playing a board game related to the trucking industry, of the step of winning the game by building a fleet of trucks of a predefined number.

Another feature of the present invention is the provision in a method for playing a board game related to the trucking industry, of the step of providing a direction in at least one space for taking a game truck from another player.

Another feature of the present invention is the provision in a method for playing a board game related to the trucking industry, of the step of providing a direction in at least one space for drawing a card from a first set of cards wherein at least some of the cards have directions for responding to transportation authorities.

Another feature of the present invention is the provision in a method for playing a board game related to the trucking industry, of the step of providing a direction in at least one space for drawing a card from a first set of cards wherein at least some of the cards have directions for responding to situations caused by the driver.

Another feature of the present invention is the provision in a method for playing a board game related to the trucking industry, of the step of providing a third operator for the chance element wherein the third operator determines whether a truck has crashed.

Another feature of the present invention is the provision in a method for playing a board game related to the trucking industry, of the step of providing a fourth operator for the chance element wherein the fourth operator determines whether a safety inspection must be made.

Another feature of the present invention is the provision in a method for playing a board game related to the trucking industry, of the step of providing a fifth operator for the chance element wherein the fifth operator determines whether a game truck must move backwardly.

Another feature of the present invention is the provision in a method for playing a board game related to the trucking industry, of the step of providing an opportunity to purchase a space when a game truck lands on said space.

Another feature of the present invention is the provision in a method for playing a board game related to the trucking industry, of the step of selecting the spaces to be purchased to represent a service center, truck insurance company, department of transportation, truck stop having a restaurant, weigh station, internal revenue service, produce broker, shipper, casino, tow service, truck payment center, tire service, or farmers' market.

Another feature of the present invention is the provision in a method for playing a board game related to the trucking industry, of the step of providing direction in at least one space for the reception of money by a player, wherein the step includes the step of collecting a predefined amount of money as a game truck lands on or passes over a space, the step of awarding money to a player for a pallet refund, the step of collecting money for an overshipment, the step of collecting money from an insurance fund, the step of collecting money in response to an accident, or the step of collecting a health insurance refund.

Another feature of the present invention is the provision in a method for playing a board game related to the trucking industry, of the step of providing direction in at least one space for the taking of money away from a player, wherein the step includes the step of fining a player for a no truck parking violation, the step of fining a player for a poor safety rating, the step of fining a player in response to a truck audit, the step of paying road tax, the step of paying a predefined amount of money to each of the other players, the step of making a quarterly insurance payment, the step of sending money home, or the step of paying fuel tax.

Another feature of the present invention is the provision in a method for playing a board game related to the trucking industry, of the steps of having a player operate a chance element for determining how many spaces said game trucks move forwardly along said course and how many spaces said game trucks move backwardly along said course and having said player who operated said chance element make a decision on which of said game trucks to move, which of said game trucks to move forwardly along said course, and which of said game trucks to move backwardly along said course, such that said player who operated said chance element may methodically plan moves in advance.

Another feature of the present invention is the provision in a method for playing a board game related to the trucking industry, of the steps of taking money away from a player by providing a direction in at least one space for taking money away from a player and having said player place said money taken away at a first location; and having a player receive money from said first location by providing a direction in at least one space for reception of money by a player.

Another feature of the present invention is the provision in a trucking game board apparatus, of a course having first, second, third and fourth corner spaces wherein the first corner space provides a direction of having a player receive money, wherein the second corner space provides a direction of having a player go to the third corner space, wherein the third corner space represents a home office and provides a direction of taking money away from a player for a poor safety rating, and wherein the fourth corner space represents an accident crash site and provides a direction of having a player receive money from an insurance fund.

Another feature of the present invention is the provision in a trucking game board apparatus, of a plastic sheet including a course and game trucks for moving along said course, wherein said plastic sheet comprises four plastic sheet sections, with each of the plastic sheet sections having edges, a plastic fold line between each of the sheet sections, wherein the plastic sheet includes a folded out configuration on which the game trucks are moved along said course, wherein, in the folded out configuration, the plastic sheet is flat, wherein the plastic sheet includes a folded configuration for storage, wherein, in said folded configuration, said plastic sheet is generally flat, wherein, in said folded configuration, each of the plastic sheet sections confronts each of the other plastic sheet sections, and wherein, in said folded configuration, the edges of the plastic sheet sections are aligned with respective edges of the other plastic sheet sections.

Another feature of the present invention is the provision in a trucking board game apparatus, of a die having a first side with indicia of a truck.

An advantage of the present invention is its resemblance to real life. Like the 1849 gold rush, where the winners were the businessmen who supplied the workers panning for gold, the winner of the present game is most likely be the one who dabbles in trucking peripherals. For example, the winner is most likely to be the player who owns most of the spaces where truckers, after landing thereon, must pay for peripheral related to tax, food, repair, service, insurance or other factor.

Another real life lesson is taught by the chance element where a roll of the dice determines how far your trucks move and therefore how many times you collect a salary for driving around the board. In the trucking industry, one never knows where the call for the next load will come from. If by chance your truck is close to the loading site, you are likely to get the load, keep moving, and keep making money.

Another real life lesson is taught by the chance element where a roll of the dice determines whether you add to your fleet of trucks. In the trucking industry, it is clearly unpredictable whether your trucking company will have a profitable year. Some years, if you are lucky, you may show a sufficient profit to buy a truck.

Another real life lesson is taught by the chance element where a roll of the dice determines whether a truck crashes. In the trucking industry, just like with a personal car, it is by chance that you are in the wrong place at the wrong time.

Another real life lesson is taught by the chance element where a roll of the dice will determine whether your truck will undergo a safety inspection. In the trucking industry, your truck can undergo an inspection at most anytime and at most anyplace.

Another real life lesson is taught by the set up of the game board. There are relatively few spaces related to "money in" and a relatively great number of spaces related to "money out." In the trucking industry, there are relatively few ways to make money except by "keeping moving" and there are a relatively great number of ways in which your money is taken away.

Other and further features and advantages of the present invention will become apparent to those skilled in the art upon a review of the accompanying specification and drawings.

IN THE DRAWINGS

DESCRIPTION OF THE PREFERRED EMBODIMENT

Figure 1:
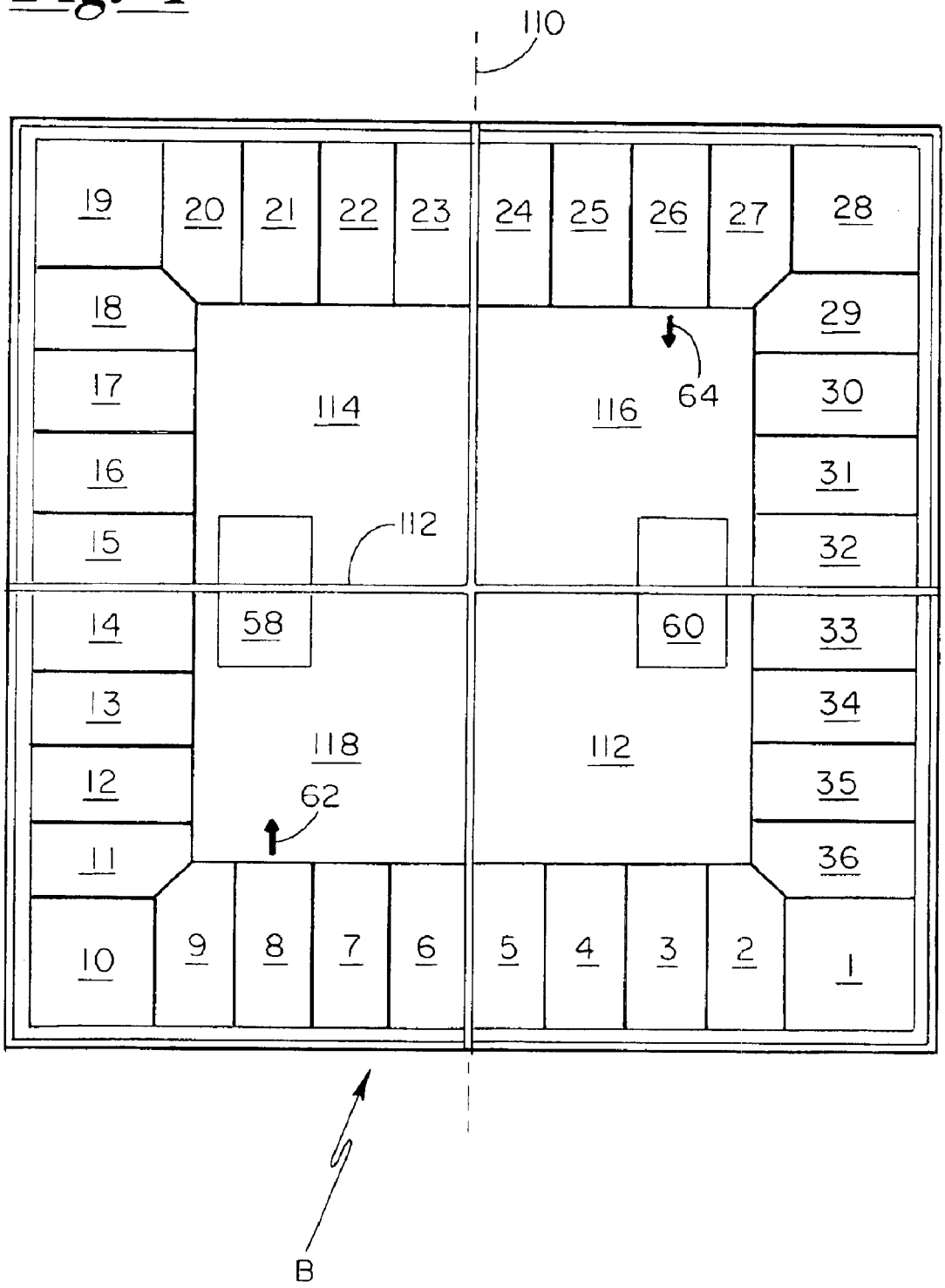
FIG. 1 is a top plan view of the game board of the present invention.

As shown in FIG. 1, the game apparatus of the present invention includes a game board generally indicated by the character B.

The 36 Game Board Spaces

The game board B has a course or path having 36 spaces indicated by reference numbers 1–36. Directions are provided in each of the spaces. When a player's game truck 40 lands on a space, the respective direction in the space may be followed or, in some cases, must be followed. Each of the spaces 1–36 are described below.

Figure 2:
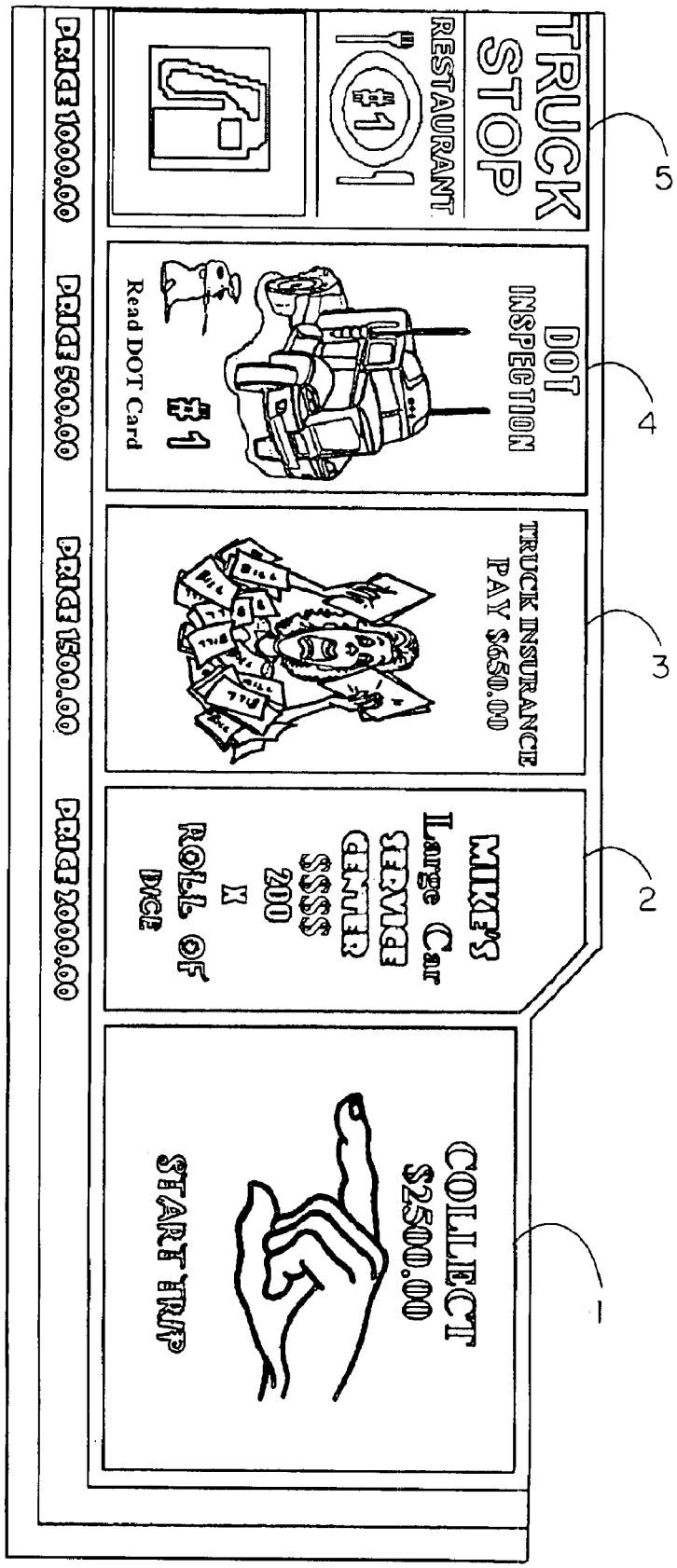
FIG. 2 is a detail view of a portion of the game board of FIG. 1.

As shown in FIG. 2, space 1 is where a game truck 40 begins its trip. The indicia "collect $2500" and "start trip" is found in space 1, and a player owning a game truck 40 collects $2500 from the bank for either landing on space 1 (except at the beginning of the game) or passing over space 1 (except when moving from the DOT AUDIT space 28 to the HOME OFFICE space 10). Further, a drawing of a pointing hand where the first finger is pointing is found in space 1 and this pointing hand indicates the direction of forward movement for the game truck 40. Backward movement of a game truck 40 takes place where a skull face side 42 of the dice 44 is rolled. A player may be designated as the banker for controlling the bank of money.

Space 2 is a company entitled Mike's Large Car Service Center. A player owning a game truck 40 landing on this space is provided the opportunity to buy this trucking related company, and secure the respective holding card 46, for the price of $2000. A player owning a game truck 40 landing on this space, if the company is owned, must pay to the player owning this company an amount totaling $200 times the roll of the two dice 44.

Space 3 is an insurance company entitled Truck Insurance. A player owning a game truck 40 landing on this space is provided the opportunity to buy this trucking related company, and secure the respective holding card 46, for the price of $1500. A game truck 40 landing on this space, if the company is owned, must pay to the player owning this company an amount totaling $650 times the number of trucks the player owns. If space 3 is not owned when a game truck 40 lands thereon, then the player owning the game truck 40 must pay the bank $650 times the number of trucks the player owns. A player may be designated as the banker.

Space 4 is a pseudo public company entitled DOT Inspection #1. A player owning a game truck 40 landing on this space is provided with the opportunity to buy this trucking related company, and secure the respective holding card 46, for the price of $500. A player owning a game truck 40 landing on this space must draw a DOT chance card 48 and follow the directions on the card. If the DOT chance card 48 provides directions to pay money, then the money must be paid to the owner of space 4. If space 4 is not owned when a game truck 40 lands thereon, then the player owning the game truck 40 must place the money on the letters "T" and "R" in the word "TRUCOPOLY" on the game board B. Money placed on these letters is designated as the Insurance Fund. If the player who owns space 4 also owns a game truck 40 that lands on space 4, such player must also draw a DOT chance card 48 and follow the directions thereon and, if such directions require the payment of money, such money is paid to the Insurance Fund.

Space 5 is a company entitled Truck Stop Restaurant #1. A player owning a game truck 40 landing on this space is provided the opportunity to buy this trucking related company, and secure the respective holding card 46, for the price of $1000. A player owning a game truck 40 landing on this space, if the company is owned, must pay to the player owning this company an amount shown on the holding card 46 for this company, which is in this case $1200.

Figure 3:
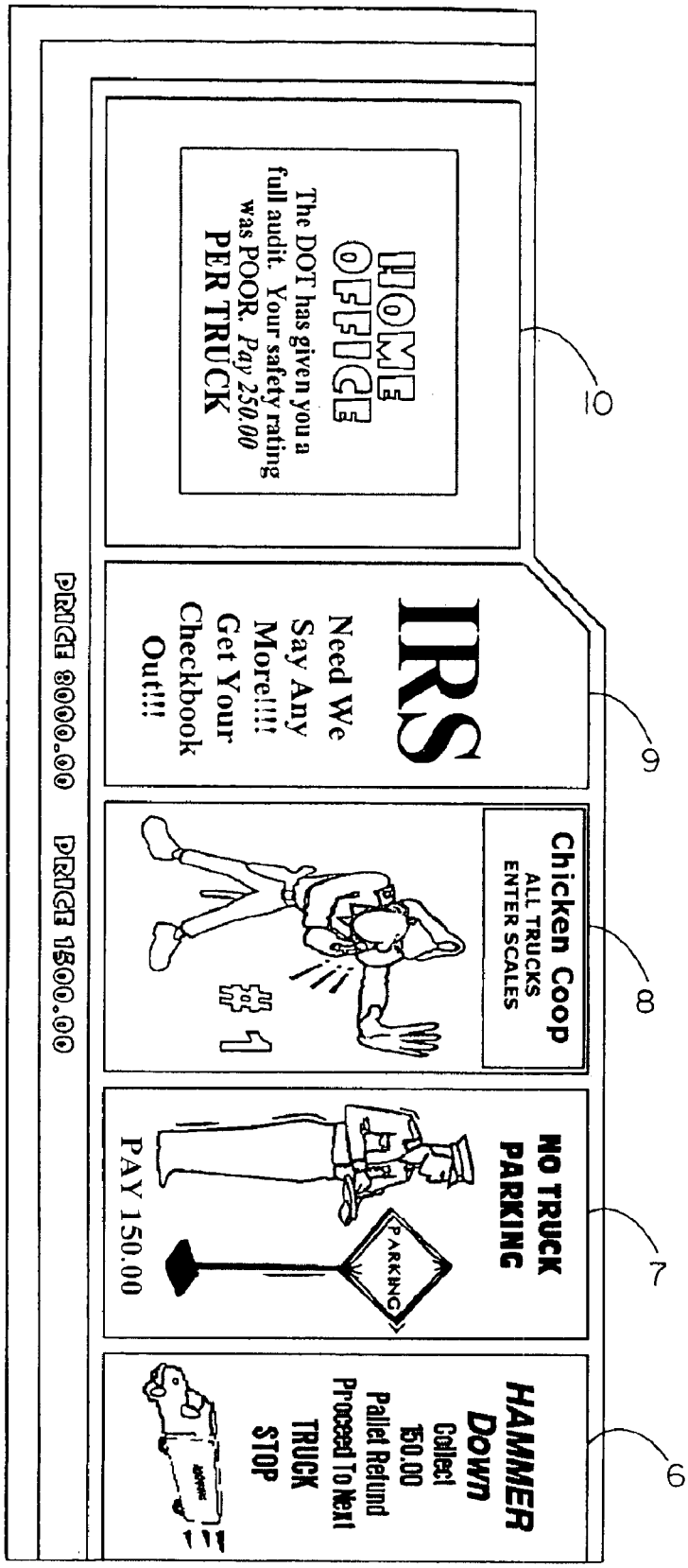
FIG. 3 is a detail view of a portion of the game board of FIG. 1.

As shown in FIG. 3, space 6 is entitled Hammer Down, which is slang for "making good time." A player owning a game truck 40 landing on this space collects $150 from the bank for a pallet refund. Then, as space 6 indicates, the game truck 40 landing on this space must then be placed on space 14, which is the next truck stop restaurant, whereupon the player must comply with the provisions of space 14.

Space 7 is entitled No Truck Parking. The player owning the game truck 40 landing on this space must pay $150 to the Insurance Fund.

Space 8 is a pseudo public company entitled Chicken Coop #1. "Chicken coop" is slang for a weigh station. A player owning a game truck 40 landing on this space is provided the opportunity to buy this trucking related company, and secure the respective holding card 46, for the price of $1500. A player owning a game truck 40 landing on this space must draw a DRIVER chance card 50 and follow the directions on the card. If the DRIVER chance card 50 provides directions to pay money, then the money must be paid to the owner of space 8. If space 8 is not owned when a game truck 40 lands thereon, then the player owning the game truck 40 must place the money on the letters "T" and "R" in the word "TRUCOPOLY" on the game board B. Money placed on these letters is designated as the Insurance Fund. If the player who owns space 8 also owns a game truck 40 that lands on space 8, then such player must also draw a DRIVER chance card 50 and follow the directions thereon and, if such directions require the payment of money, then such money is paid to the Insurance Fund. After complying with the directions on the DRIVER chance card 50, the player moves his or her game truck 40 to space 13, entitled Weigh Station Bypass, thereby bypassing the Home Office space 10 where he or she would be audited by the DOT (Department of Transportation) and where he or she would pay $250 per truck.

Space 9 is a pseudo public company entitled IRS. A game truck 40 landing on this space provides the player owning the game truck 40 the opportunity to buy this trucking related company, and secure the respective holding card 46, for the price of $8000. A game truck 40 landing on this space must pay to the player owning this space the amount of $3000. If space 9 is not owned when a game truck 40 lands thereon, the player owning the game truck 40 must pay $3000 to the bank. If the player who owns space 9 also owns a game truck 40 that lands on space 9, such player must pay $3000 to the bank.

Figure 4:
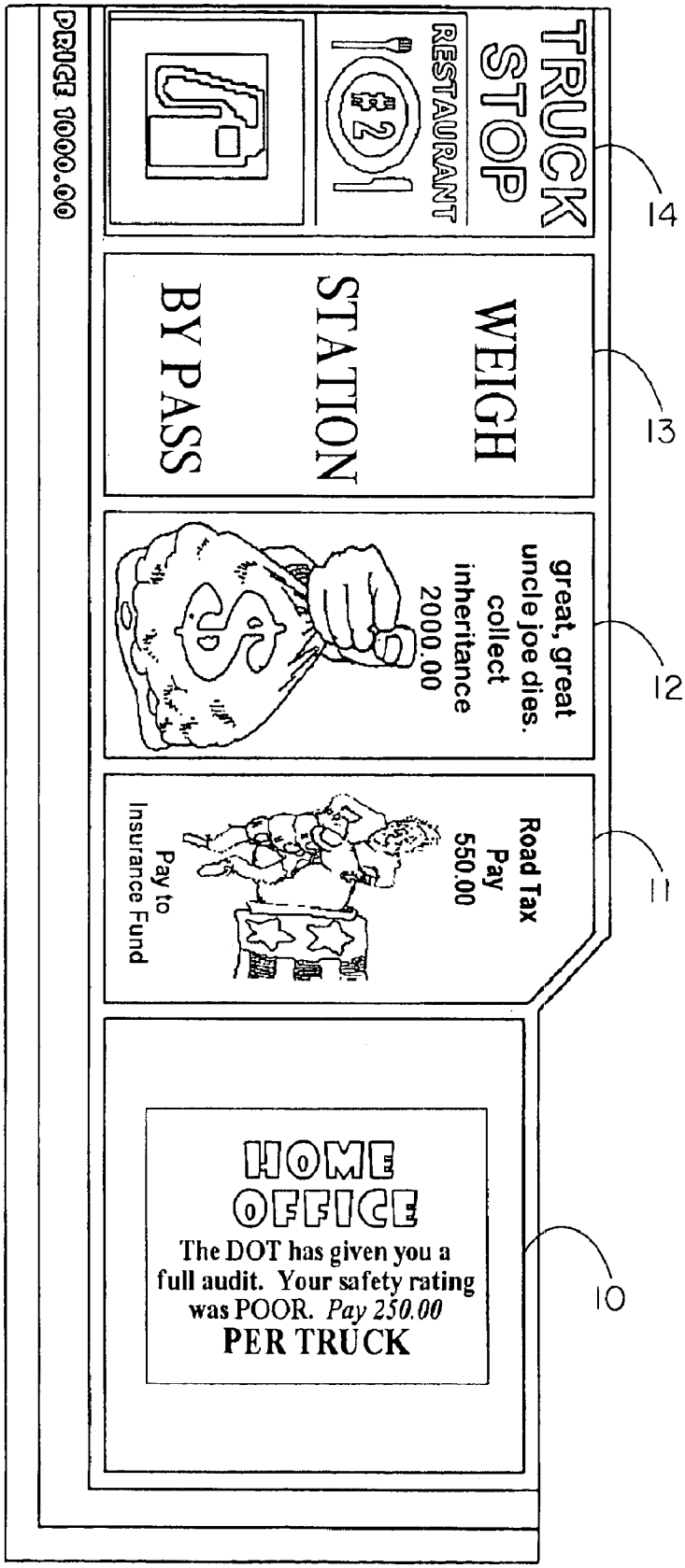
FIG. 4 is a detail view of a portion of the game board of FIG. 1.

As shown in FIG. 4, space 10 is entitled Home Office and states the DOT (Department of Transportation) has given the player a full audit and that the player's safety rating was poor. A player owning a game truck 40 landing on this space must pay $250 for every truck that he owns (not merely the one landing on space 10) to the Insurance Fund.

Space 11 is entitled Road Tax. A player owning a game truck 40 landing on this space must pay $550 to the Insurance Fund.

Space 12 is entitled Great, Great Uncle Joe Dies: Collect Inheritance. A player owning a game truck 40 landing on this space receives $2000 from the bank.

Space 13 is entitled Weigh Station Bypass. A player owning a game truck 40 landing on this space is entitled to nothing, but also pays nothing. Game trucks 40 may land on this space from a natural roll of the dice or may land on this space via space 8.

Space 14 is a company entitled Truck Stop Restaurant #2. A player owning a game truck 40 landing on this space is provided the opportunity to buy this trucking related company, and secure the respective holding card 46, for the price of $1000. A player owning a game truck 40 landing on this space, if the company is owned, must pay to the player owning this company an amount shown on the holding card 46 for this company, which is in this case $1200.

Figure 5:
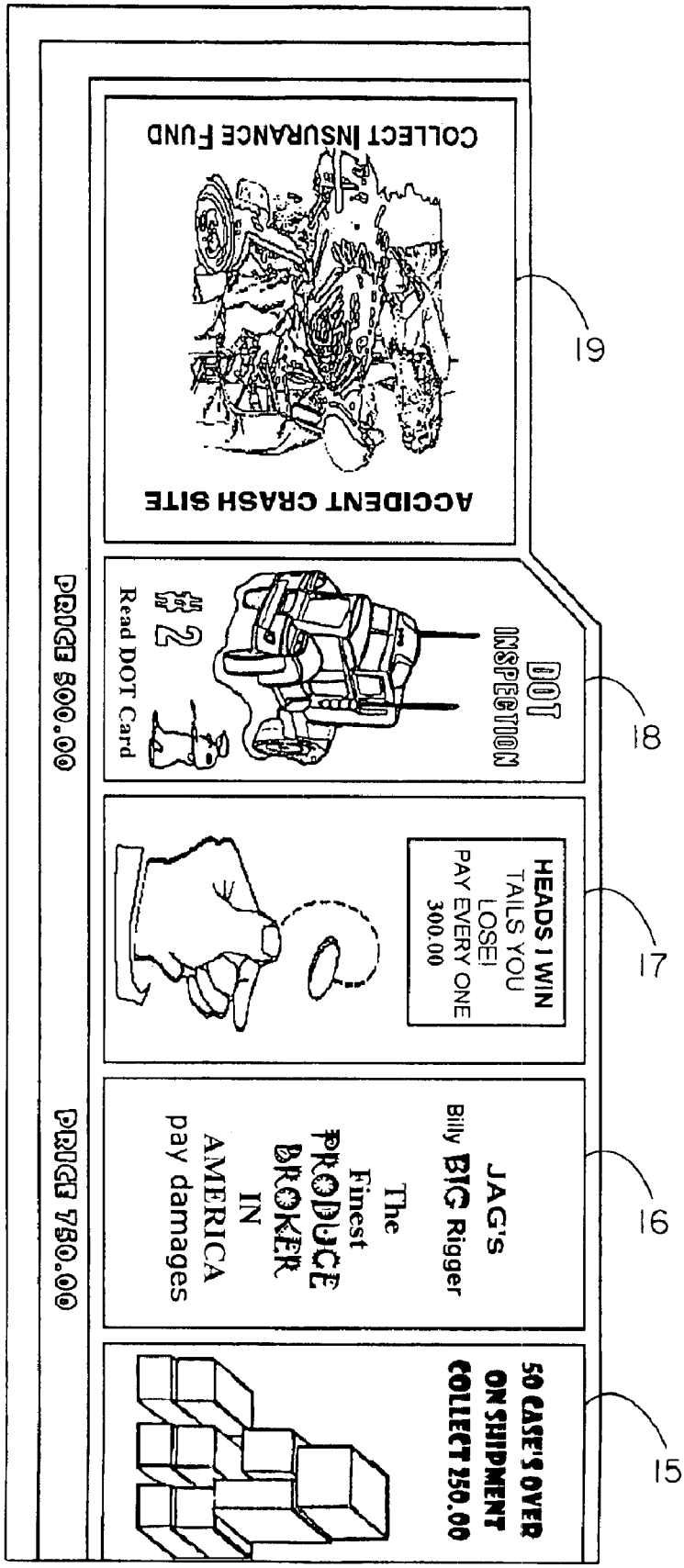
FIG. 5 is a detail view of a portion of the game board of FIG. 1.

As shown in FIG. 5, space 15 is entitled 50 Cases Over On Shipment. A player owning a game truck 40 landing on this space collects $250 from the bank.

Space 16 is a company entitled JAG'S Billy BIG Rigger: The Finest Produce Broker in America. A game truck 40 landing on this space provides the player owning the game truck 40 the opportunity to buy this trucking related company, and secure the respective holding card 46, for the price of $750. A game truck 40 landing on this space, if the company is owned, must pay to the player owning this company the amount of $400, which is shown on the respective holding card 46.

Space 17 is entitled Heads I Win, Tails You Lose! A player owning a game truck 40 landing on this space must pay to every player the amount of $300.

Space 18 is a pseudo public company entitled DOT Inspection #2. A player owning a game truck 40 landing on this space is provided with the opportunity to buy this trucking related company, and secure the respective holding card 46, for the price of $500. A player owning a game truck 40 landing on this space must draw a DOT chance card 48 and follow the directions on the card. If the DOT chance card 48 provides directions to pay money, then the money must be paid to the owner of space 18. If space 18 is not owned when a game truck 40 lands thereon, the player owning such game truck 40 must place the money on the letters "T" and "R" in the word "TRUCOPOLY" on the game board B. Money placed on these letters is designated as the Insurance Fund. If the player who owns space 18 also owns a game truck 40 that lands on space 18, such player must also draw a DOT chance card 48 and follow the directions thereon and, if such directions require the payment of money, such money is paid to the Insurance Fund.

Figure 6:
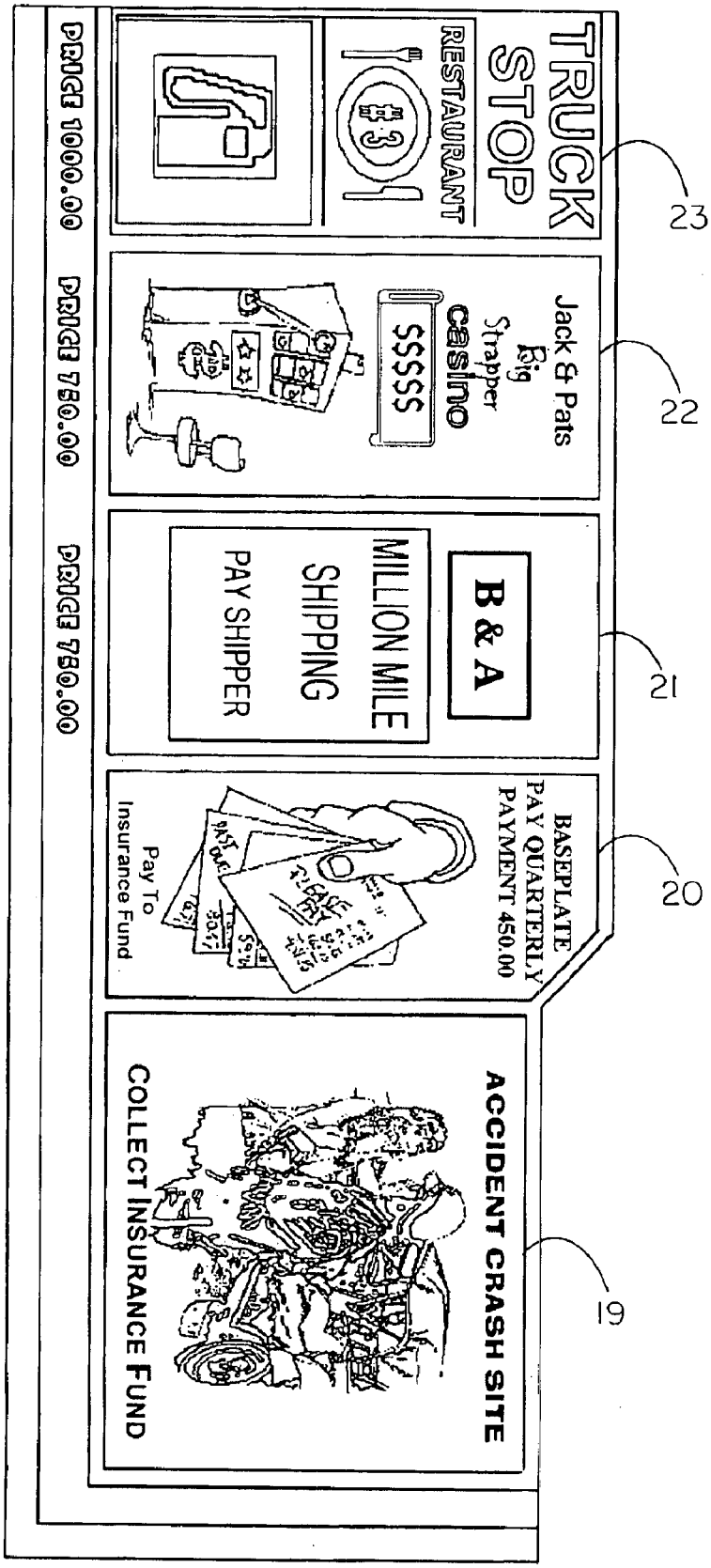
FIG. 6 is a detail view of a portion of the game board of FIG. 1.

As shown in FIG. 6, space 19 is entitled Accident Crash Site. A player owning a game truck 40 landing on this space collects whatever money is in the Insurance Fund, i.e., that amount of money on the letters "T" and "R" in the word "TRUCOPOLY" on the game board B.

Space 20 is entitled Baseplate Quarterly Payment. A player owning a game truck 40 landing on this space pays $450 to the Insurance Fund.

Space 21 is a company entitled B & A: Million Mile Shipping. A player owning a game truck 40 landing on this space is provided the opportunity to buy this trucking related company, and secure the respective holding card 46, for the price of $750. A game truck 40 landing on this space, if the company is owned, must pay to the player owning this company the amount of $650, which is shown on the respective holding card 46.

Space 22 is a company entitled Jack & Pats Big Strapper Casino. A player owning a game truck 40 landing on this space is provided the opportunity to buy this nontrucking related company, and secure the respective holding card 46, for the price of $750. A game truck 40 landing on this space, if the company is owned, must pay to the player owning this company the amount of $700, which is shown on the respective holding card 46.

Space 23 is a company entitled Truck Stop Restaurant #3. A player owning a game truck 40 landing on this space is provided the opportunity to buy this trucking related company, and secure the respective holding card 46, for the price of $1000. A player owning a game truck 40 landing on this space, if the company is owned, must pay to the player owning this company an amount shown on the holding card 46 for this company, which is in this case $1200.

Figure 7:
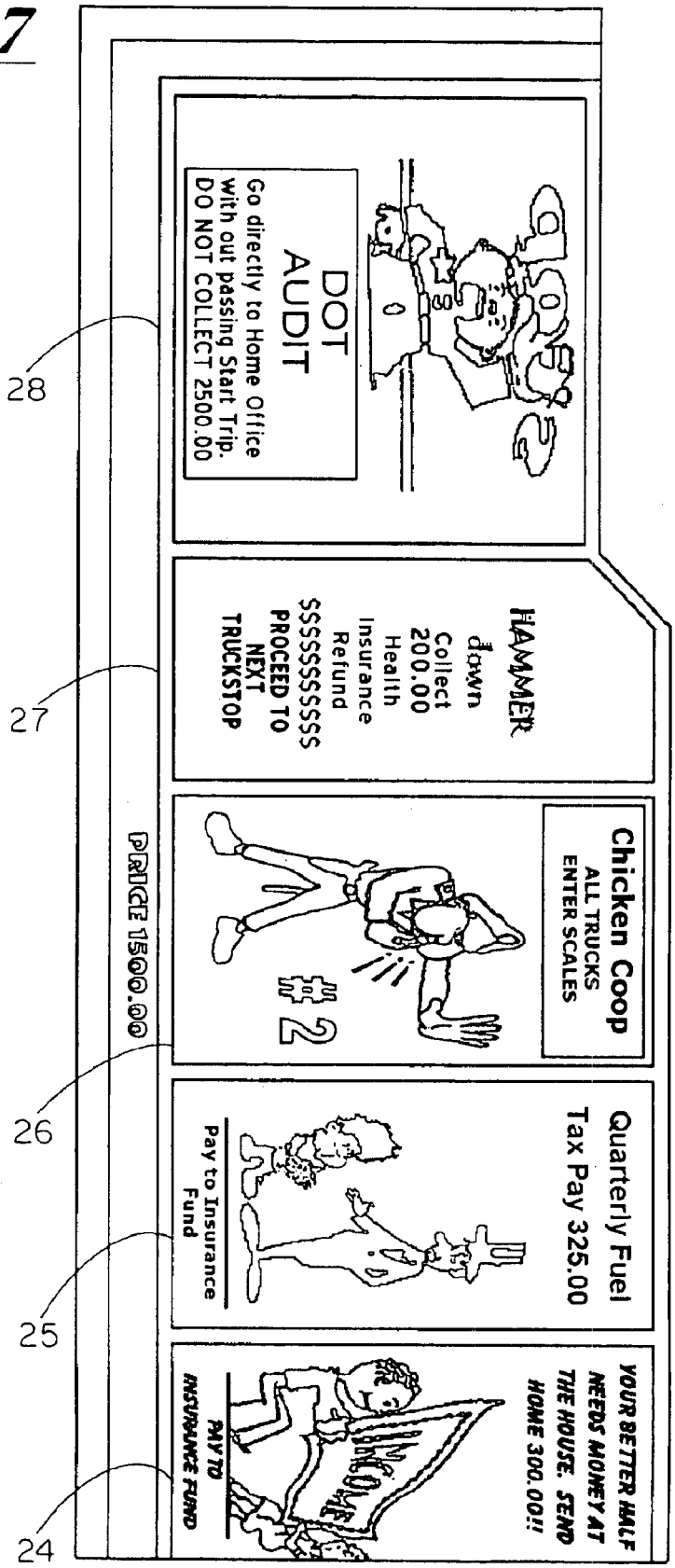
FIG. 7 is a detail view of a portion of the game board of FIG. 1.

As shown in FIG. 7, space 24 is entitled Your Better Half Needs Money At The House: Send Home $300! A player owning a game truck 40 landing on this space must pay $300 to the Insurance Fund.

Space 25 is entitled Quarterly Fuel Tax. A player owning a game truck 40 landing on this space must pay $325 to the Insurance Fund.

Space 26 is a pseudo public company entitled Chicken Coop #2. "Chicken coop" is slang for a weigh station. A player owning a game truck 40 landing on this space is provided the opportunity to buy this trucking related company, and secure the respective holding card 46, for the price of $1500. A player owning a game truck 40 landing on this space must draw a DRIVER chance card 50 and follow the directions on the card. If the DRIVER chance card 50 provides directions to pay money, then the money must be paid to the owner of space 26. If space 26 is not owned when a game truck 40 lands thereon, then the player owning the game truck 40 must place the money on the letters "T" and "R" in the word "TRUCOPOLY" on the game board B. Money placed on these letters is designated as the Insurance Fund. If the player who owns space 26 also owns a game truck 40 that lands on space 26, then such player must also draw a DRIVER chance card 50 and follow the directions thereon and, if such directions require the payment of money, then such money is paid to the Insurance Fund. After complying with the directions on the DRIVER chance card 50, the player moves his or her game truck 40 to space 31, entitled Weigh Station Bypass, thereby bypassing the DOT AUDIT space 28 where he or she would be required to move such game truck 40 to space 10 to be audited by the DOT (Department of Transportation) and where he or she would pay $250 per truck.

Space 27 is entitled Hammer Down, which is slang for "making good time." A player owning a game truck 40 landing on this space collects $200 from the bank for a health insurance refund. Then, as space 27 indicates, the game truck 40 landing on this space must then be placed on space 32, which is the next truck stop restaurant, whereupon the player must comply with the provisions of space 32.

Figure 8:
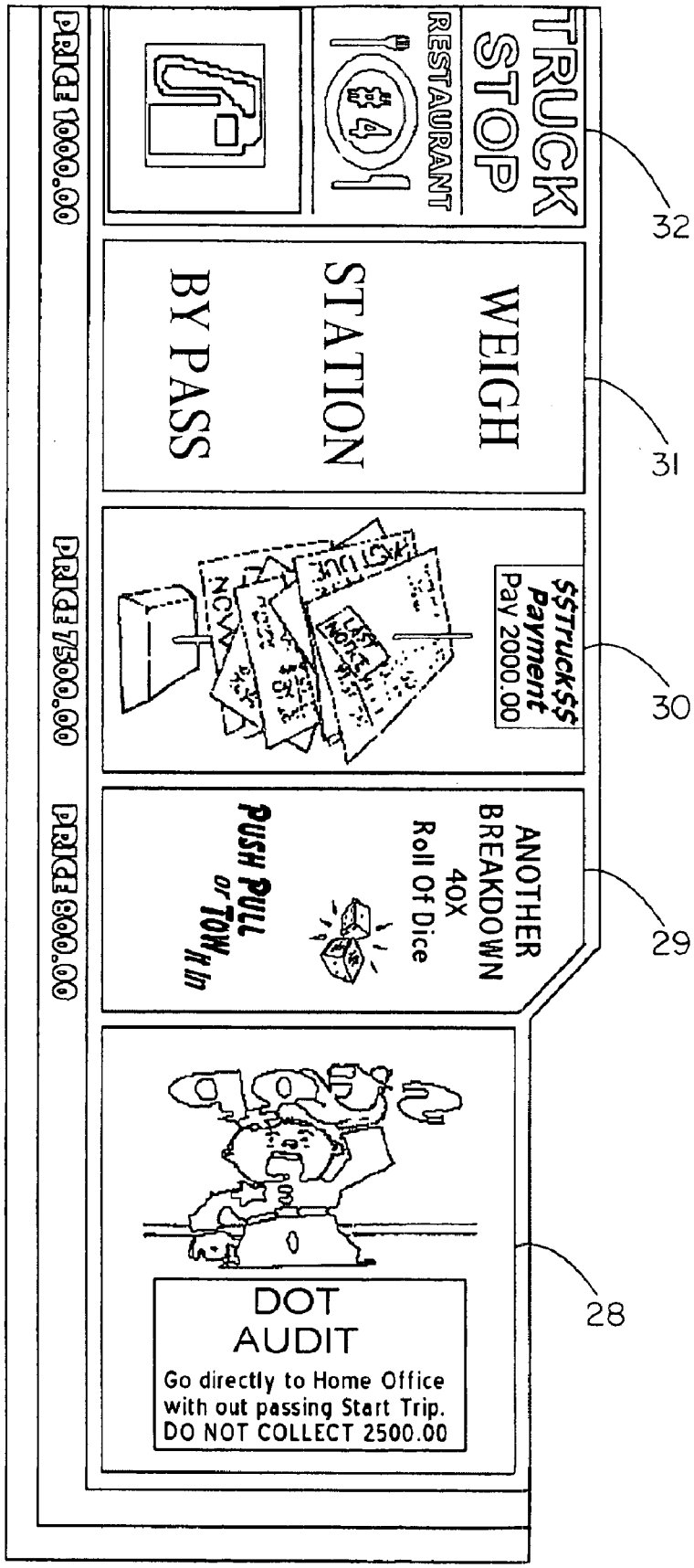
FIG. 8 is a detail view of a portion of the game board of FIG. 1.

As shown in FIG. 8, space 28 is entitled DOT AUDIT. A player owning a game truck 40 landing on this space must place such game truck 40 on space 10 entitled HOME OFFICE and follow the directions for space 10. In doing so, it is considered that such player does not pass space 1 and does not collect $2500 for such space.

Space 29 is a company entitled Push, Pull And Tow. A player owning a game truck 40 landing on this space is provided the opportunity to buy this trucking related company, and secure the respective holding card 46, for the price of $800. A player owning a game truck 40 landing on this space, if the company is owned, must pay to the player owning this company an amount totaling $40 times the roll of the two dice 44.

Space 30 is a truck finance company entitled Truck Payment. A player owning a game truck 40 landing on this space is provided the opportunity to buy this trucking related company, and secure the respective holding card 46, for the price of $7500. A game truck 40 landing on this space, if the company is owned, must pay to the player owning this company an amount totaling $2000 times the number of trucks the player owns. If space 30 is not owned when a game truck 40 lands thereon, then the player owning the game truck 40 must pay the bank $2000 times the number of trucks the player owns. A player may be designated as the banker.

Space 31 is entitled Weigh Station Bypass. A player owning a game truck 40 landing on this space is entitled to nothing, but also pays nothing. Game trucks 40 may land on this space from a natural roll of the dice or may land on this space via space 26.

Space 32 is a company entitled Truck Stop Restaurant #4. A player owning a game truck 40 landing on this space is provided the opportunity to buy this trucking related company, and secure the respective holding card 46, for the price of $1000. A player owning a game truck 40 landing on this space, if the company is owned, must pay to the player owning this company an amount shown on the holding card 46 for this company, which is in this case $1200.

Figure 9:
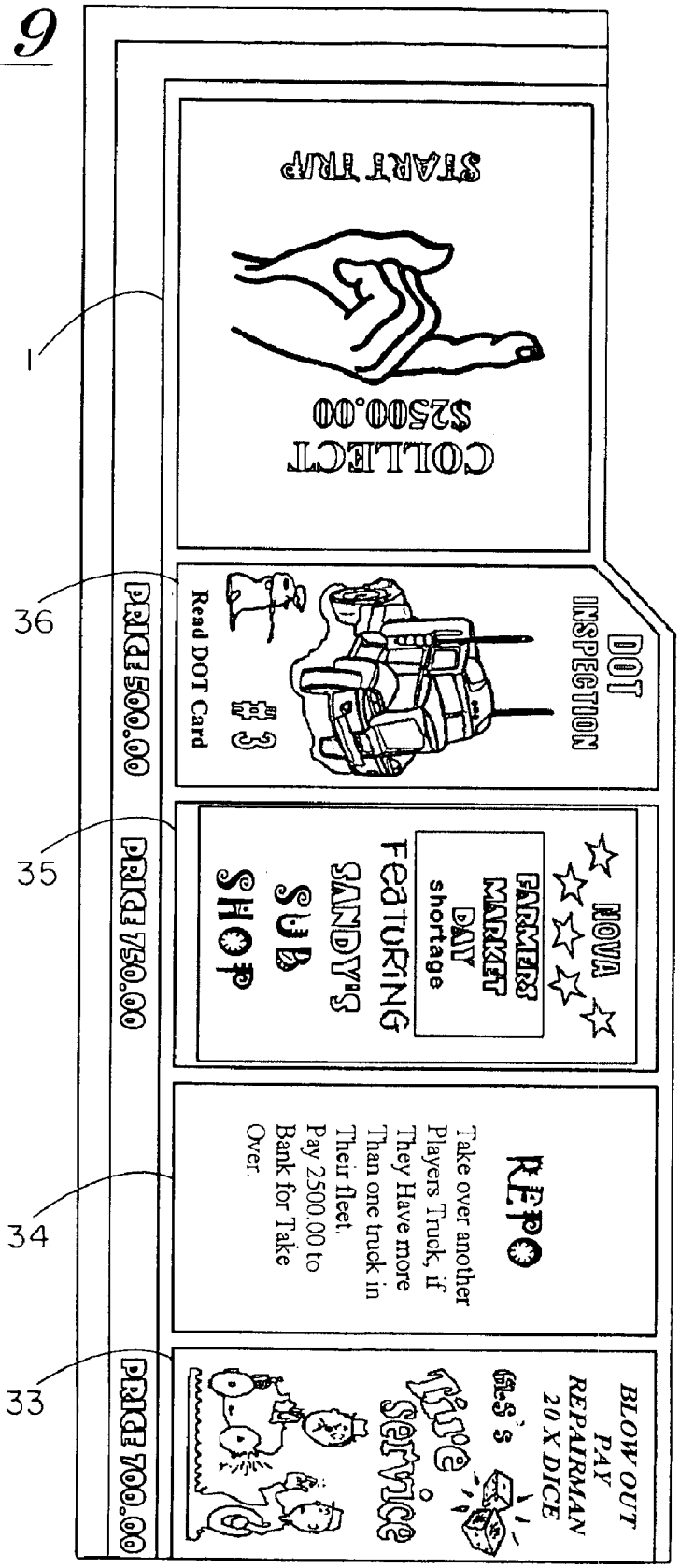
FIG. 9 is a detail view of a portion of the game board of FIG. 1.
Figure 10:
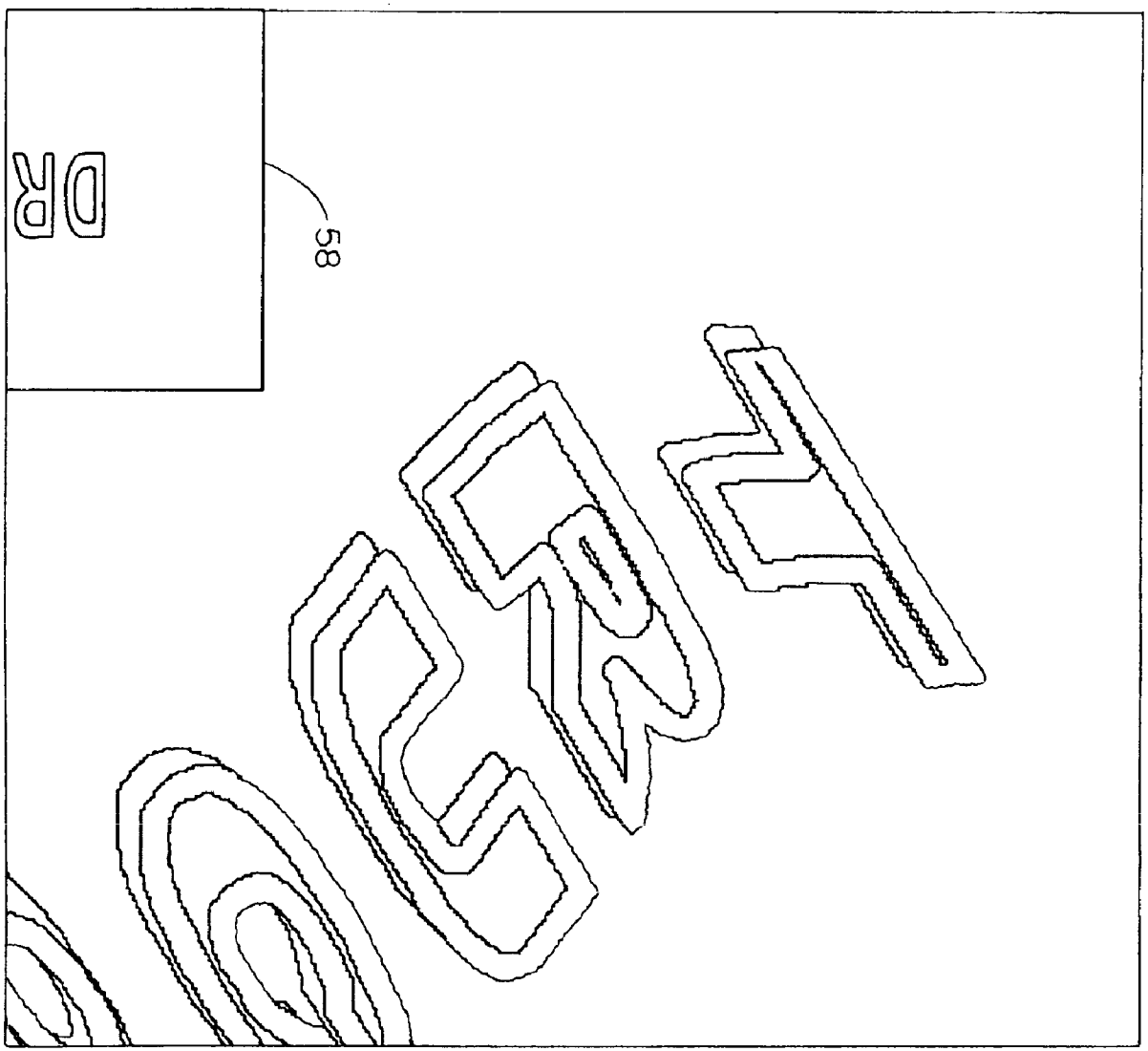
FIG. 10 is a detail view of a portion of the game board of FIG. 1.
Figure 11:
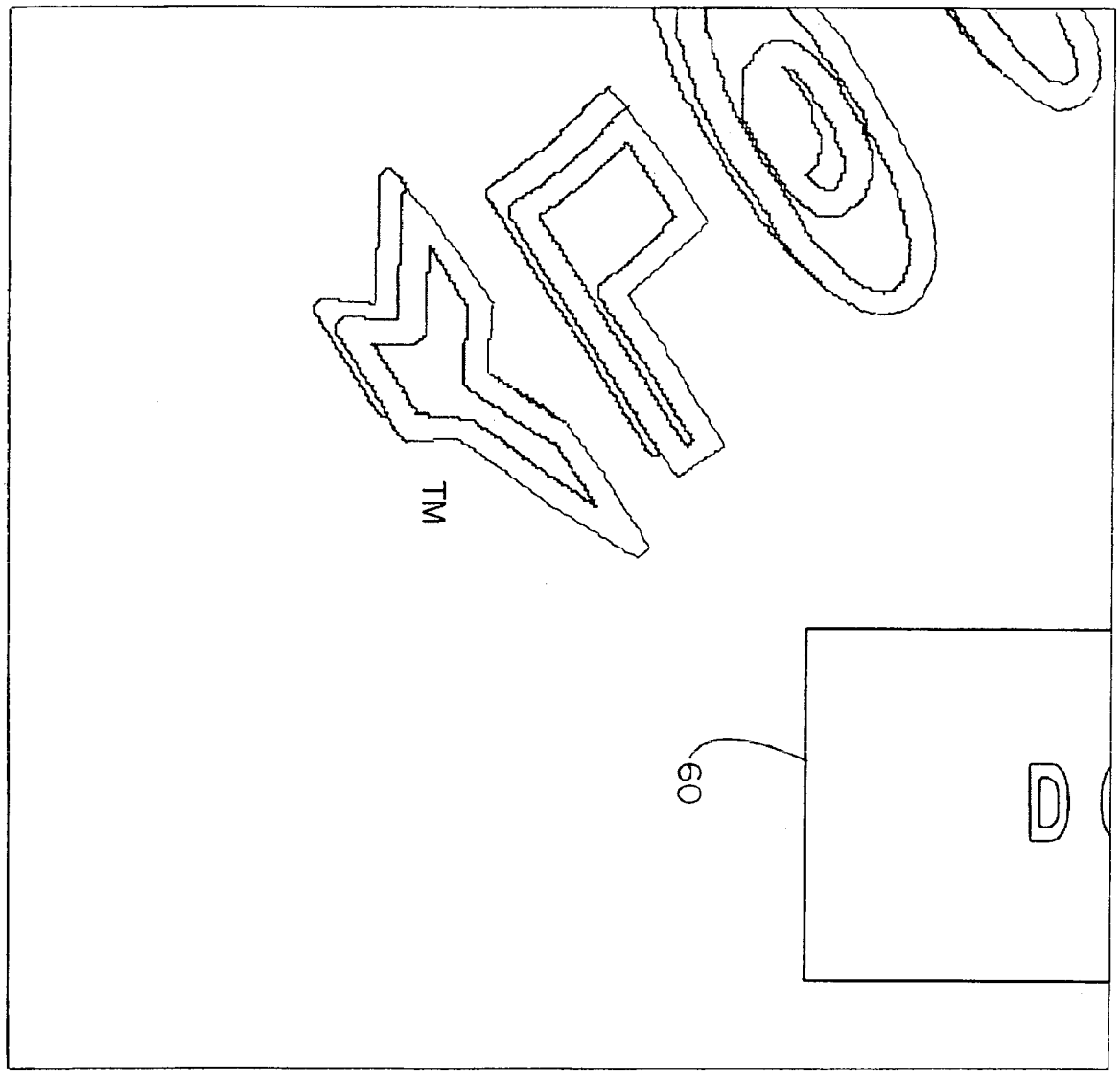
FIG. 11 is a detail view of a portion of the game board of FIG. 1.
Figure 12:
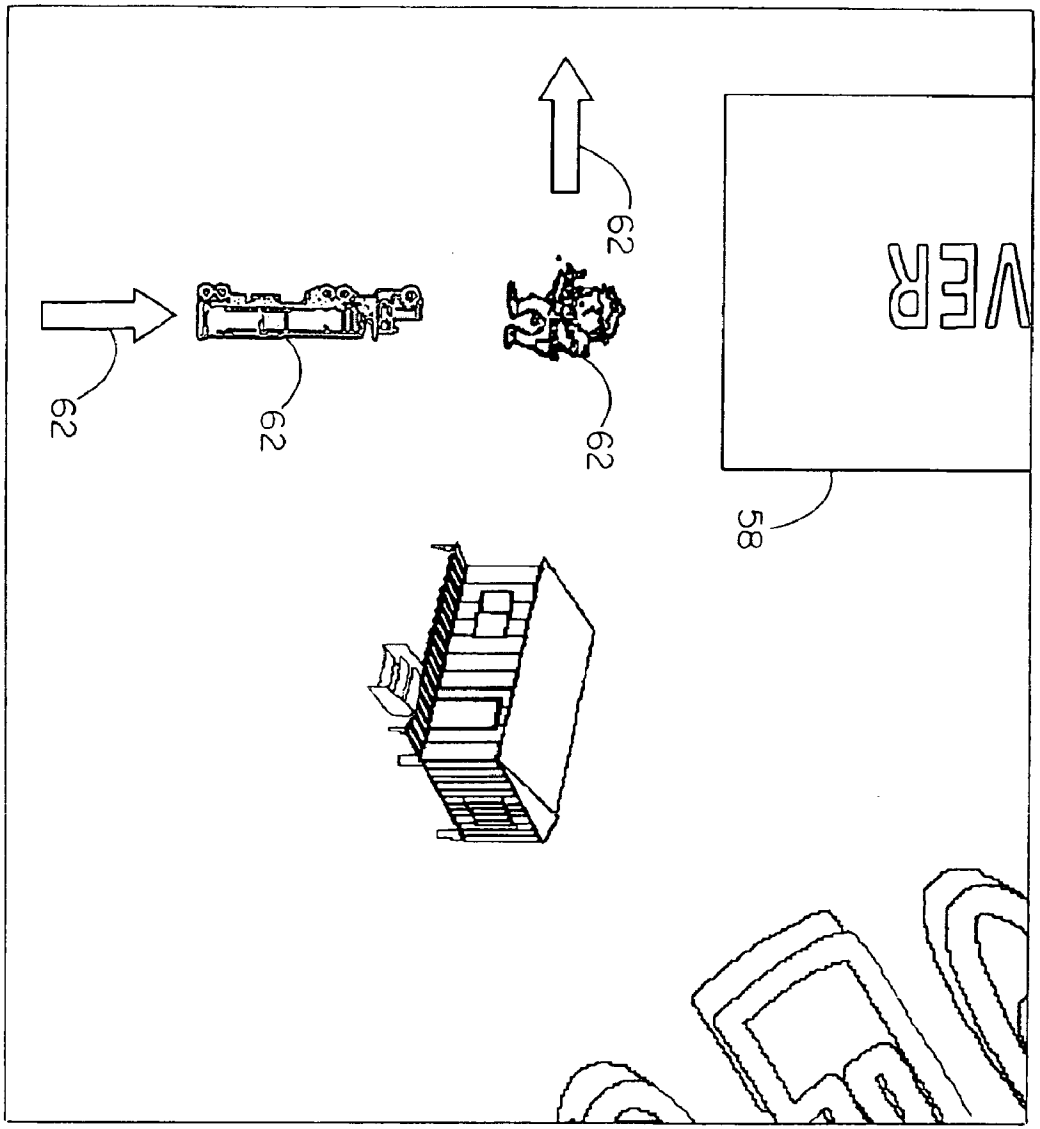
FIG. 12 is a detail view of a portion of the game board of FIG. 1.
Figure 13:
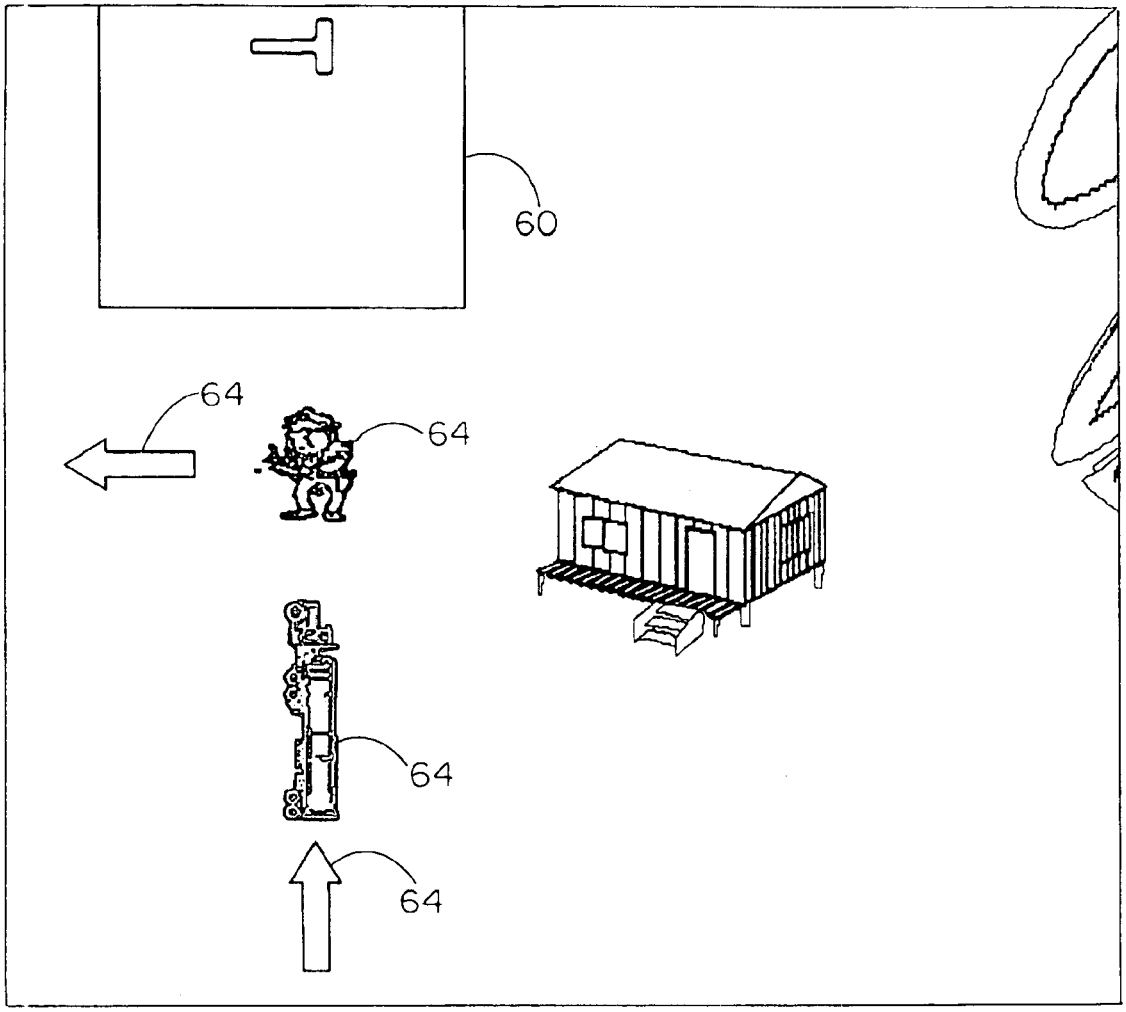
FIG. 13 is a detail view of a portion of the game board of FIG. 1.

As shown in FIG. 9, space 33 is a company entitled GLS's Tire Service. A player owning a game truck 40 landing on this space is provided the opportunity to buy this trucking related company, and secure the respective holding card 46, for the price of $700. A player owning a game truck 40 landing on this space, if the company is owned, must pay to the player owning this company an amount totaling $20 times the roll of the two dice 44 for repair of a blow out.

Space 34 is entitled REPO. A player owning a game truck 40 landing on this space must take over ownership of a game truck 40 of another player if such player has more than one game truck 40 in his or her fleet of game trucks 40. The player taking over ownership of such truck must pay to the bank the amount of $2500 for taking over such game truck 40. The game truck 40 over which ownership has been taken is replaced (on the same space) with a game truck 40 having a characteristic unique to the player who took over ownership.

Space 35 is a company entitled Nova Farmers Market: Featuring Sandy's Sub Shop. A player owning a game truck 40 landing on this space is provided the opportunity to buy this nontrucking related company, and secure the respective holding card 46, for the price of $750. A player owning a game truck 40 landing on this space, if the company is owned, must pay to the player owning this company the amount of $550 for the bad deed of a fork lift driver who damaged two skids of apples and loaded them anyway without the driver knowing.

Space 36 is a pseudo public company entitled DOT Inspection #3. A player owning a game truck 40 landing on this space is provided with the opportunity to buy this trucking related company, and secure the respective holding card 46, for the price of $500. A player owning a game truck 40 landing on this space must draw a DOT chance card 48 and follow the directions on the card. If the DOT chance card 48 provides directions to pay money, then the money must be paid to the owner of space 36. If space 36 is not owned when a game truck 40 lands thereon, then the player owning the game truck 40 must place the money on the letters "T" and "R" in the word "TRUCOPOLY" on the game board B. Money placed on these letters is designated as the Insurance Fund. If the player who owns space 36 also owns a game truck 40 that lands on space 36, then such player must also draw a DOT chance card 48 and follow the directions thereon and, if such directions require the payment of money, then such money is paid to the Insurance Fund.

Space 1 is the space after space 36 and, again, a player owning a game truck 40 that lands on or passes space 1 collects the amount of $2500 from the bank (except where the game truck 40 is being moved from the DOT AUDIT space 28 to the HOME OFFICE space 10 and except where the game truck 40 "lands on" space 1 by virtue of the game being started).

The Center of the Board

A central portion of the game board B is shown in FIGS. 10, 11, 12 and 13.

A central portion of the game board B includes the word "TRUCOPOLY." The letters "T" and "R" is the location designated for placing the game bills (money) for the Insurance Fund. However, another location may be designated for the Insurance Fund if desired.

The central portion of the game board B includes a location 58 for the stack of DRIVER chance cards 50.

The central portion of the game board B includes a location 60 for the stack of DOT chance cards 48.

As to the holding cards 46, these cards are held by the banker until the associated space is purchased by a player.

The central portion of the game board B further includes arrow indicia 62 showing the bypass from space 8 to space 13. The central portion of the game board B further includes arrow indicia 64 showing the bypass from space 26 to space 31. Indicia portions of such arrow indicia include a semi-trailer truck and police officer pointing the way.

The Markers or Game Trucks

Figure 14A:
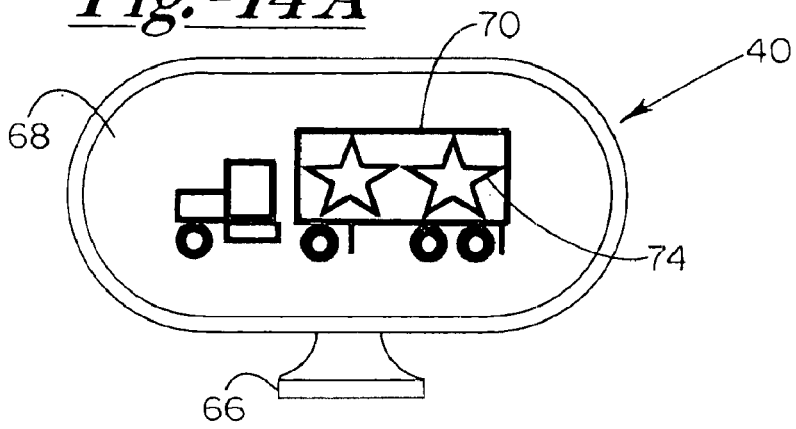
FIG. 14A is a front elevation view of a game truck or marker for being maneuvered along the game board of FIG. 1.
Figure 14B:
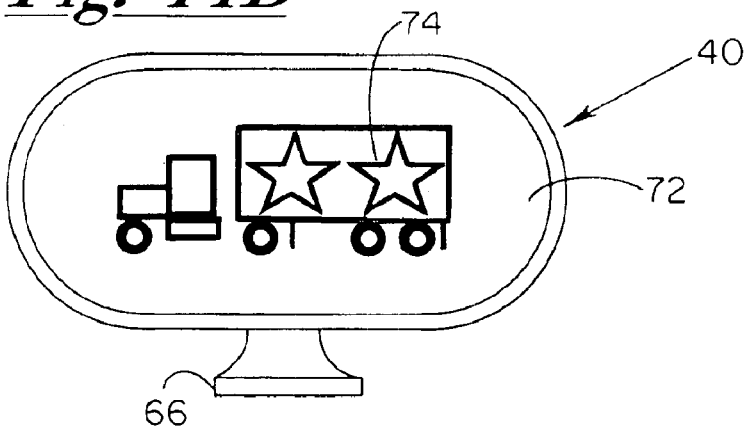
FIG. 14B is a back elevation view of the game truck or marker of FIG. 14A.
Figure 14C:
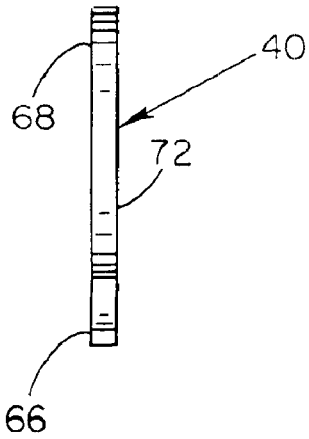
FIG. 14C is a side elevation view of the game truck or marker of FIG. 14A.

One embodiment of the markers or game trucks 40 is shown in FIGS. 14A, 14B and 14C. Each of the game trucks 40 includes a base 66, a first side 68 having indicia 70 of a semi-trailer truck, and a second side 72 having the indicia 70. The game truck 40 may include one or more characteristics to identify which player owns the game truck 40. These characteristics include different indicia 74, such as stars, hearts, happy faces or lightning bolts, and different colors molded into the marker 40 as a whole.

Figure 23A:
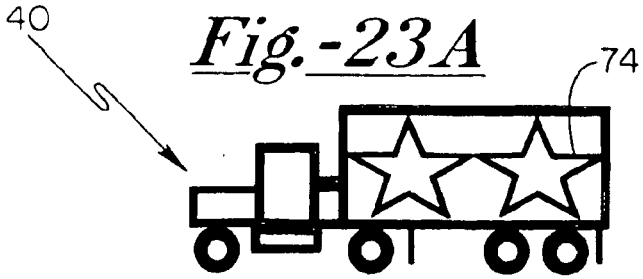
FIG. 23A is a side view of a three dimensional marker or game semi-trailer truck for the present game apparatus.
Figure 23B:
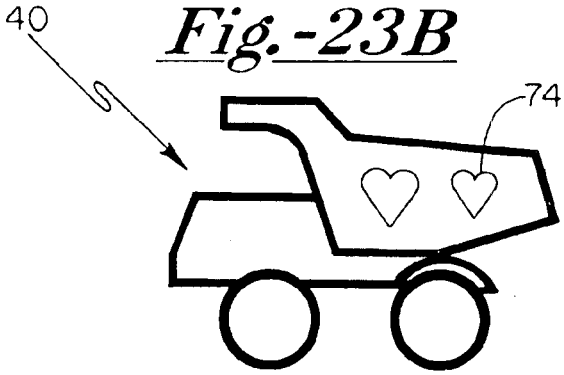
FIG. 23B is a side view of a three dimensional marker or game dump truck for the present game apparatus.
Figure 23C:
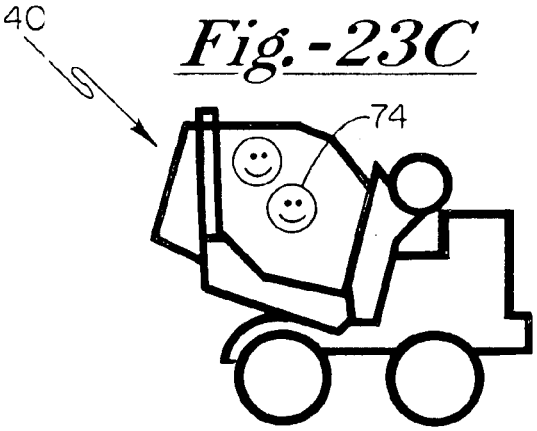
FIG. 23C is a side view of a three dimensional marker or game cement truck for the present game apparatus.
Figure 23D:
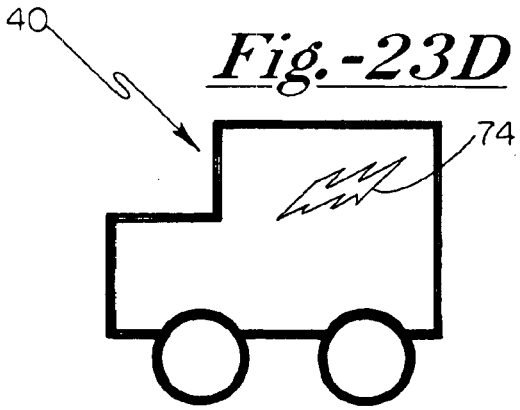
FIG. 23D is a side view of a three dimensional marker or game straight truck for the present game apparatus.

Another embodiment of the markers or game trucks 40 is shown in FIGS. 23A, 23B and 23C. This embodiment is a marker that takes the form of a relatively small three dimensional truck or "game truck." Such three dimensional game trucks 40 may take the shape of a semi-trailer truck (FIG. 23A), dump truck (FIG. 23B), cement truck (FIG. 23C) or straight truck (FIG. 23D). Here the identifying characteristics may include one or more of the shape of the truck, indicia 74 on the truck, and the color or design molded into the marker 40.

The definition of game truck includes a marker of any type, including a marker that does not resemble the shape of a truck, as long as such marker has some relation to a truck, or some characteristic of a truck, or some indicia of a truck.

The present game apparatus includes ten game trucks 40 per player, such as ten orange game trucks 40, ten green game trucks 40, ten brown game trucks 40, and ten black game trucks 40 such that four sets of game trucks 40 are included.

The First Pair of Dice

Figure 15A:
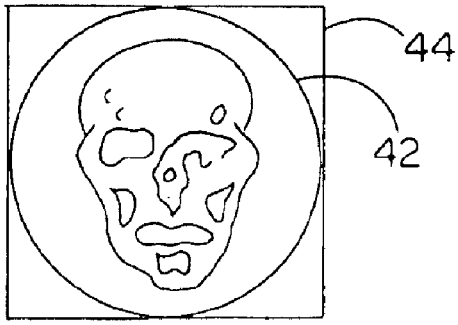
FIG. 15A is one side of a six-sided die for the game apparatus of the present invention and has indicia of a skull face and represents the number one.
Figure 15B:
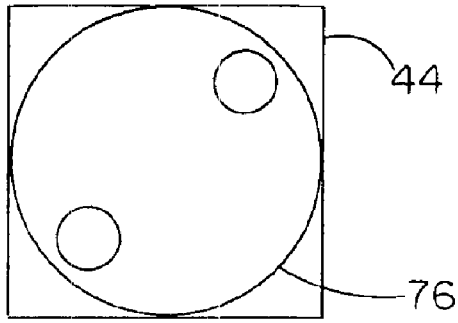
FIG. 15B is another side of the six-sided die of FIG. 15A and represents the number two.
Figure 15C:
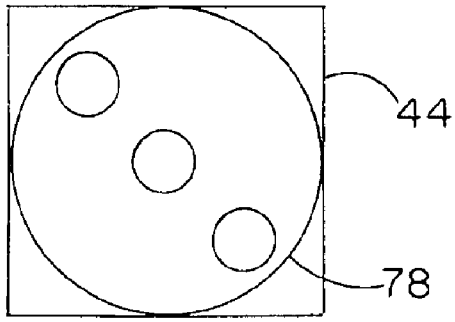
FIG. 15C is another side of the six-sided die of FIG. 15A and represents the number three.
Figure 15D:
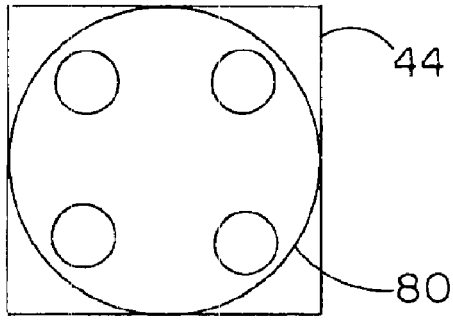
FIG. 15D is another side of the six-sided die of FIG. 15A and represents the number four.
Figure 15E:
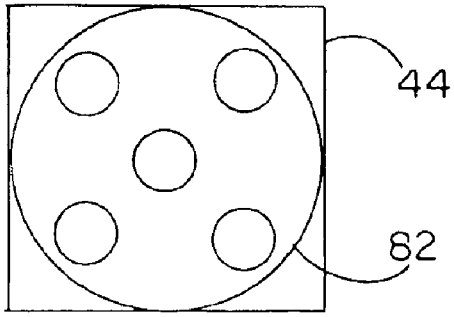
FIG. 15E is another side of the six-sided die of FIG. 15A and represents the number five.
Figure 15F:
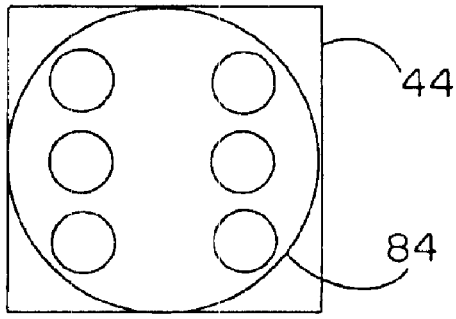
FIG. 15F is another side of the six-sided die of FIG. 15A and represents the number six.
Figure 16A:
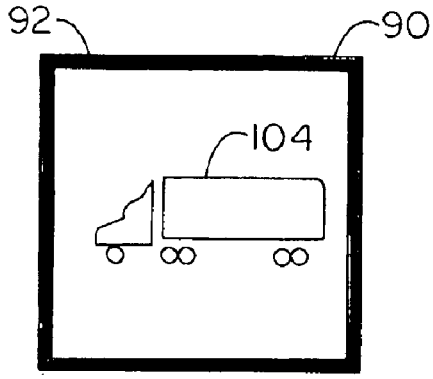
FIG. 16A is one side of a six-sided die for the game apparatus of the present invention and has indicia of a semi-trailer truck.
Figure 16B:
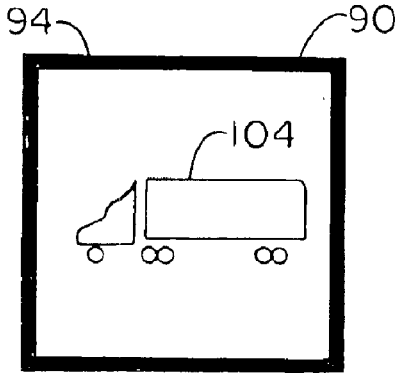
FIG. 16B is another side of the six-sided die of FIG. 16A and has indicia of a semi-trailer truck.
Figure 16C:
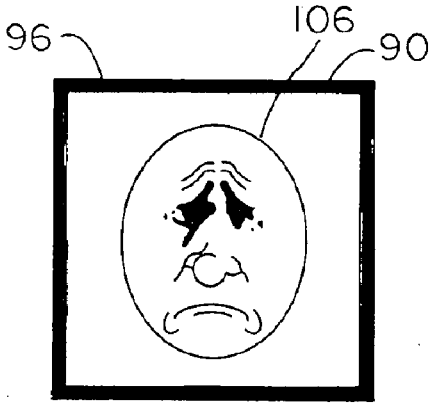
FIG. 16C is another side of the six-sided die of FIG. 16A and has indicia of a sad face.
Figure 16D:
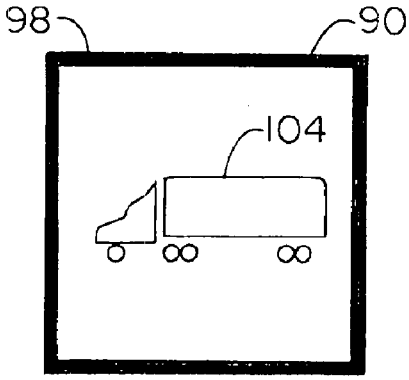
FIG. 16D is another side of the six-sided die of FIG. 16A and has indicia of a semi-trailer truck.
Figure 16E:
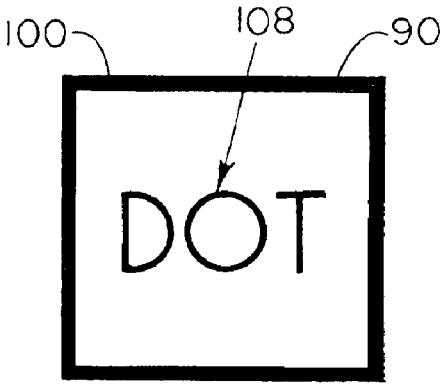
FIG. 16E is another side of the six-sided die of FIG. 16A and has the indicia DOT representing the department of transportation.
Figure 16F:
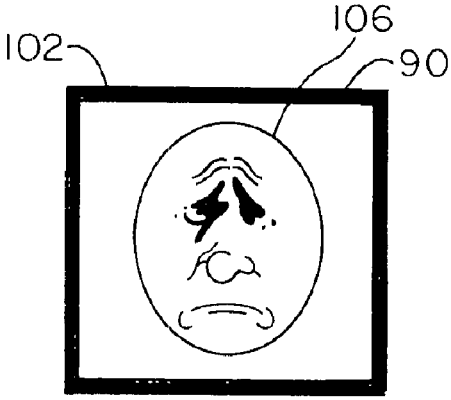
FIG. 16F is another side of the six-sided die of FIG. 16A and has indicia of a sad face.

One die 44 is shown in FIGS. 15A, 15B, 15C, 15D, 15E, and 15F. For each of his or her moves, a player throws two die 44 (and two die 90 as described below). Die 44 includes six faces. Each die 44 is colored red. One face 42 is shown in FIG. 15A and includes the indicia of a skull face. Face 42 represents the number one and directs a player rolling this face to move one of his or her game trucks 40 backwardly one space.

Die faces 76, 78, 80, 82, and 84 are shown in FIGS. 15B, 15C, 15D, 15E, and 15F respectively and represent the numbers two, three, four, five and six respectively. A player rolling a face two through six must move one truck forwardly the number of spaces shown by the face of the die 44.

The game apparatus according to the present invention includes two die 44. Each die 44 corresponds to travel of one truck such that a player must choose to move one game truck 40 on the basis of one die 44 and another game truck 40 on the basis of another die 44.

When a player has only one truck, the player must combine the number thrown by two die 44 and backward movement provided by skull face 42 does not apply.

If a player rolls double numbers with the two die 44, then the player must take another turn. If the player again rolls double numbers, he or she takes another turn. If the player again rolls double numbers such that doubles are rolled three times in a row, the player loses his or her turn and all of the game trucks 40 owned by the player must go to the HOME OFFICE space 10, whereupon the player must follow the directions of space 10.

If a player rolls two skull faces 42 and the player has owns at least two game trucks 40, then the player must move one game truck 40 back one space and another game truck 40 back one space.

If a player rolls one skull face 42 for one die 44 and a number two through six for the other die 44, then the player moves one game truck 40 back one space and another game truck 40 the respective number two through six that was rolled.

The Second Pair of Dice

The game apparatus of the present invention includes two die 90. Each die 90 is colored white. One such die 90 is shown in FIGS. 16A, 16B, 16C, 16D, 16E, 16F, and 16G, each of which shows a respective different face 92, 94, 96, 98, 100, and 102 of the six-sided die 90. Each of faces 92, 94 and 98 shows indicia 104 of a semi-trailer truck. Each of faces 96 and 102 shows indicia 106 of a sad face. Face 100 shows indicia of a "DOT" that stands for Department of Transportation.

A player rolls the two die 90 at the same time (which is the time the two die 44 are rolled). If a player rolls two or more truck indicia 104, then the player may purchase a single truck; however, such truck must be purchased only after the player completes all of his or her other sub-moves, such as moving his or her already purchased trucks, paying his or her fines, purchases spaces if he or she chooses to do so, etc. Only upon completion of such sub-moves may such player purchase such single truck, which must then put on space 1 such that a player builds his or her fleet of trucks one game truck at a time, such that over time a player may have nine game trucks moving on the course (ten game trucks win the game), such that as the game progresses a player may choose from among one to nine game trucks to move, such that a player may plan moves in advance, and such that play is methodical.

If a player rolls two unhappy face indicia 106, then such player has crashed a game truck 40 and such player must pay $2500 to the Insurance Fund and such player's turn is immediately over, but the player keeps the game truck 40 and keeps the game truck 40 on the same space.

When a player rolls two DOT indicia 108, all of such player's game trucks 40 must go to the HOME OFFICE space 10 whereupon such player must follow the directions of space 10.

It is noted that the two die 44 and the two die 90 are rolled at the same time such that a player puts all four die in one hand and then tosses the four die to roll the four die.

The DOT Chance Cards

Figure 17A:
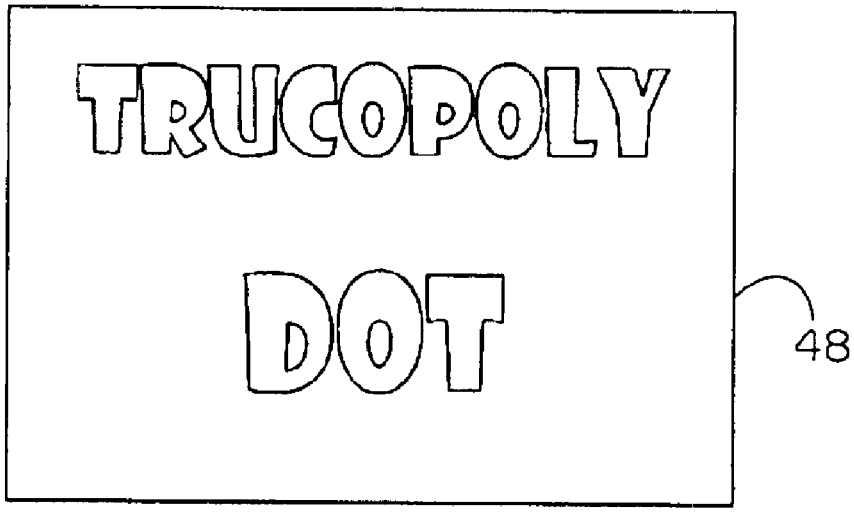
FIG. 17A illustrates the front view for each of the DOT chance cards for the game apparatus of the present invention.
Figure 17B:
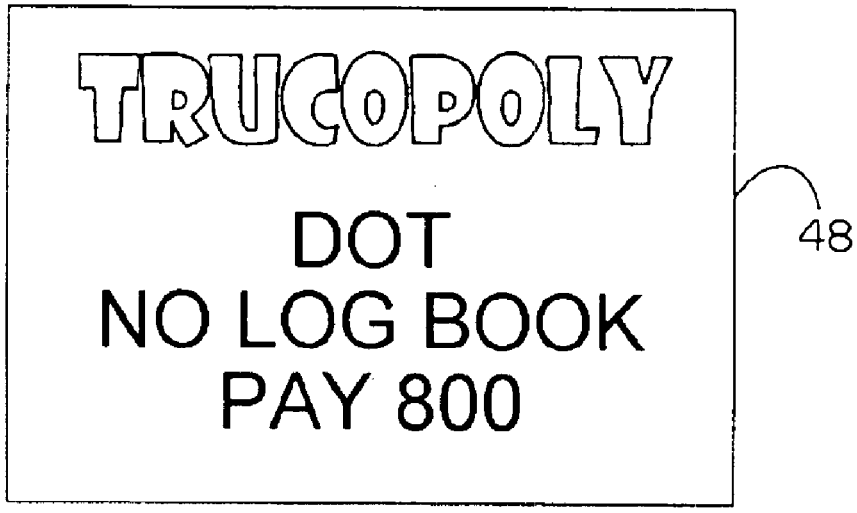
FIG. 17B illustrates the back view for at least one of the DOT chance cards of FIG. 17A.

As shown in FIGS. 17A and 17B, the present game apparatus includes red DOT chance cards 48. "DOT" is an abbreviation for "Department of Transportation." The DOT chance cards 48 are placed on location 60 face down. The generic upper face for all DOT chance cards 48 is shown in FIG. 17A. The unique lower face of one chance card is shown in FIG. 17B and includes a direction which a player must take upon drawing such card. There are thirty DOT chance cards 48 having the respective following directions on their respective lower faces:

1. You've failed a level 3 inspection pay $1500;
2. Failed inspection pay $950;
3. Out of hours pay $750;
4. Out of hours pay $500;
5. Out of hours pay $750;
6. Out of hours pay $500;
7. Everything OK collect $900;
8. Expired Medical Card pay $600;
9. Expired Medical Card pay $600;
10. Overweight pay $900;
11. Overweight pay $1000;
12. Overweight pay $900;
13. Overweight on Gross and Drives pay $1500;
14. Overweight pay $800;
15. Overweight pay $1200;
16. Overweight pay $925;
17. Overweight pay $1000;
18. Overweight pay $1200;
19. Overweight pay $800;
20. Overweight pay $1350;
21. Level 3 Inspection you failed! Pay $1050;
22. Out of hours, no log book, and Overweight pay $1500;
23. Out of hours, no log book, and Overweight pay $1500;
24. No log book pay $800;
25. Portable scales say you're 1200 over on drives pay $850;
26. No log book pay $800;
27. Passed home office DOT audit, your trucks are free to go. Keep this card to get out of a future audit or you may sell it;
28. Lose your turn;
29. Caught running scales lose a turn pay $1100;
30. Out to lunch pay nothing.

The DRIVER Chance Cards

Figure 18A:
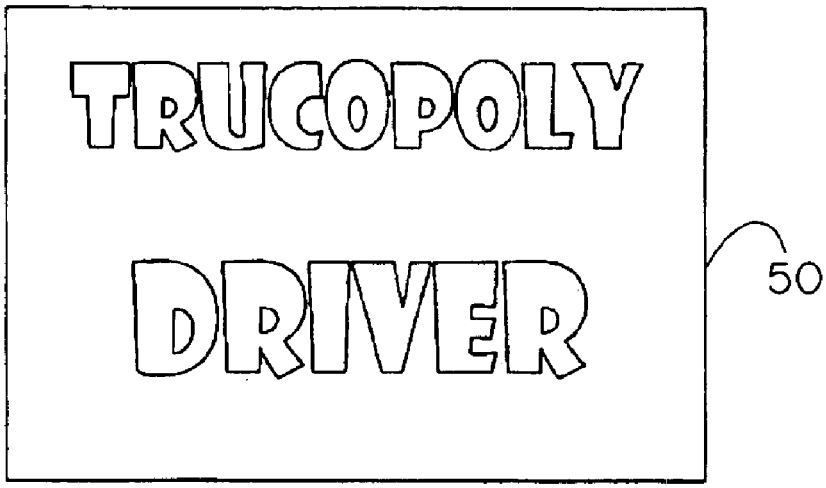
FIG. 18A illustrates the front view for each of the driver chance cards for the game apparatus of the present invention.
Figure 18B:
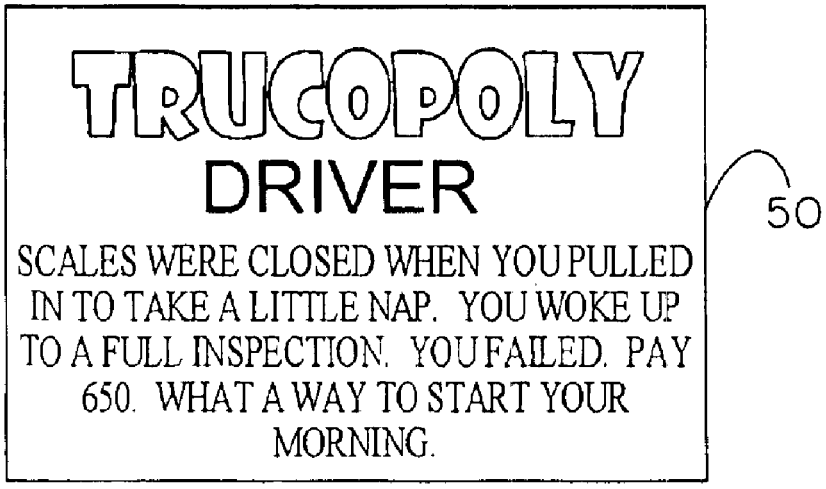
FIG. 18B illustrates the back view for at least one of the driver chance cards of FIG. 18A.

As shown in FIGS. 18A and 18B, the present game apparatus includes orange DRIVER chance cards 50. "DRIVER" means the player or owner of the game truck 40. The DRIVER chance cards 50 are placed on location 58 face down. The generic upper face for all DRIVER chance cards 50 is shown in FIG. 18A. The unique lower face of one chance card is shown in FIG. 18B and includes a direction which a player must take upon drawing such card. There are forty DRIVER chance cards 50 having the respective following directions on their respective lower faces:

1. 4000 LBS over weight pay $1100;
2. Scales were closed when you pulled in to take a little nap. You woke up to a full inspection. You failed. Pay $650. What a way to start your morning;
3. Lying on funny book pay $450;
4. You passed a level 3 inspection. DOT went over your truck and paperwork with a fine tooth comb and found nothing wrong. You are free to go with no delays;
5. Doctored up Bills of Lading pay $600;
6. Unauthorized passenger pay $400;
7. Overweight pay 100× the roll of the dice;
8. Caught without chains pay $500;
9. Its Christmas and you need to get home. Los Angeles to New York in three days doesn't work out on your funny book. You are two days ahead on your log book. Lose a turn and pay $950;
10. Your truck stalled before the scales. DOT thinks you are hiding something. They search your truck for contraband and they find stinky socks and underwear. You get a warning for stinking up the air, along with a $600 fine for illegal parking;
11. Overweight pay $75 times the roll of the dice;
12. Your truck has an oil leak, crack in the windshield, hole in the air bag and your three days behind on your log book. Pay $750;
13. Out of hours, failed safety inspection, expired medical card, expired permits, and overweight. Report to home office with all your trucks for DOT audit. Pay $250 per truck to get them back on the road;
14. Overweight pay $650;
15. Overweight pay $650;
16. Your truck passed inspection. You got caught lying on your log book but get off with just a warning, but you lose a turn;
17. No log book pay $600;
18. No log book pay $700;
19. Scales Closed. Must be my lucky day;
20. DOT was waiting for you when you went around the scales. Pay $1200;
21. Safety week and you failed inspection. Pay $900;
22. Your truck has been inspected. You have a broken spring. Your truck is unsafe to operate and put out of service. Lose a turn and pay $650;
23. Expired License pay $575;
24. You are never home, your better half says get your butt home or else! You've just been inspected and your truck is out of service. Pay $850 in fines and beg scale master for 25 cents to call the wife with the good news;
25. Safety inspection no lights or turn signals pay $575;
26. No flares or reflectors pay $550;
27. You've been caught falsifying your log book. You're out of hours and your truck has an air leak and is unsafe to operate. Lose a turn and pay $1000;
28. Your drivers never match up anything. Your comic book does not match your fuel receipts. Lying on your book again will cost you another $800 bucks. Pay up!
29. Overweight pay $1200;
30. Safety Inspection bald tires pay $600;
31. How can you drive 1200 miles in one day!! You've been caught lying on your log book. Not so funny, now is it? Pay $1000;
32. Another driver runs into your truck in the truck parking area. He has no insurance. You have to pay $850 to fix your truck;
33. You didn't have the placards showing you have hazardous materials on board. Lose a turn and pay $100× the roll of the dice;
34. Caught dodging scales pay $800;
35. You were caught going around the scale. Your permits are expired and you are overweight. Pay $800.
36. You passed your DOT inspection. You are free to go. Collect $200 from each player;
37. Failed inspection pay $500;
38. The DOT man is not in a good mood today! He's looking for a reason to write you a ticket. You got caught in his bad mood. Log book, over weight and anything else he can think of. Pay $925;
39. You're out of service, get some sleep and lose a turn pay $350;
40. The broker lied to you about your load. (but brokers don't lie) you are 5000 LBS overweight. DOT caught you dodging the scales. Pay $1400 on overweight ticket.

The Holding Cards

Figure 19A:
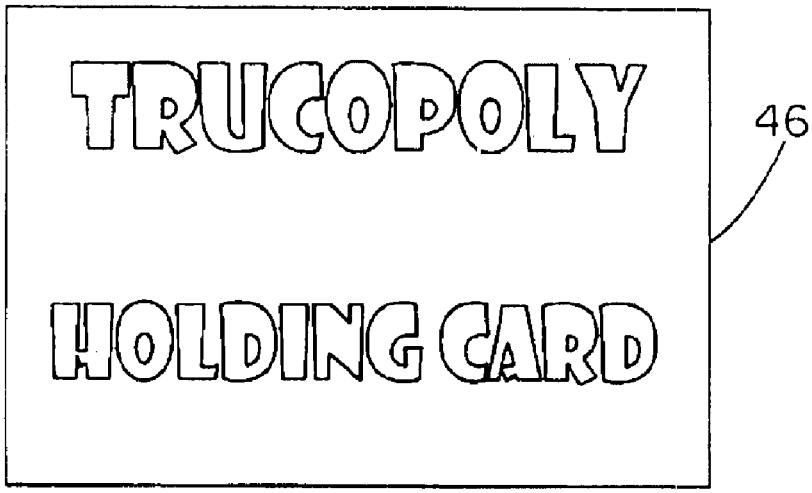
FIG. 19A illustrates the front view for each of the holding cards for the game apparatus of the present invention.
Figure 19B:
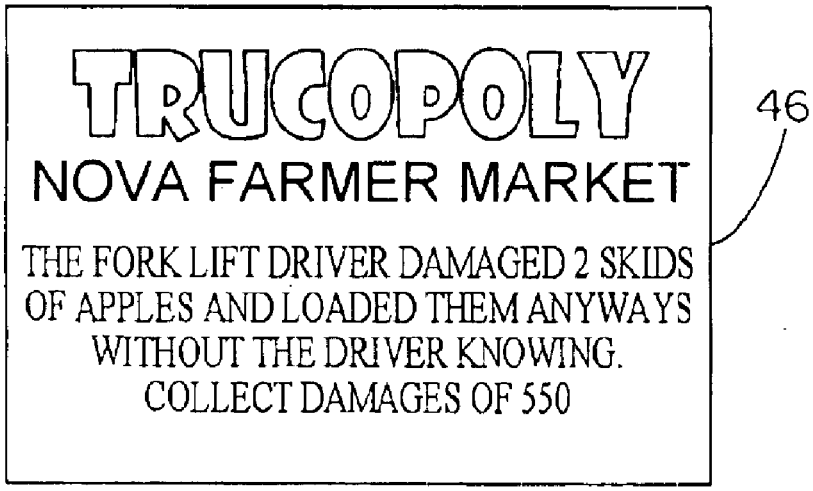
FIG. 19B illustrates the back view for one of the holding cards of FIG. 19A.

As shown in FIGS. 19A and 19B, the present game apparatus includes white Holding cards 46. "Holding"

means such card is held by the player who owns the corresponding company or space. The holding cards 46 are held by the banker until the corresponding company or space is purchased, whereupon the player who purchased the company or space holds the holding card 46. The generic upper face for all holding cards 46 is shown in FIG. 19A. The unique lower face of one holding card 46 is shown in FIG. 19B and includes the name of the company or space to which the holding card 46 corresponds. There are nineteen holding cards 46 having the respective following information on their unique faces:

1. LARGE CAR SERVICE CENTER: player pays you $200× roll of dice unless you elect to cut them a better deal (space 2);
2. TRUCK INSURANCE COMPANY: player pays you $650 per truck they have on the board (space 3);
3. DOT #1: DOT card pile tells all (space 4);
4. TRUCK STOP #1: collect $1200 (space 5);
5. CHICKEN COOP #1: driver card pile give instructions (space 8);
6. IRS: player pays you $3000 (space 9);
7. TRUCK STOP #2: collect $1200 (space 14);
8. BILLY BIG RIGGER PRODUCE BROKER: the broker lied about the rate for the load. Player pays you $400 (space 16);
9. DOT #2: DOT card pile tells all (space 18);
10. MILLION MILE SHIPPER: the shipper shorted the load on the truck. Player pays you $650 (space 21);
11. BIG STRAPPER CASINO: BIG time gambling loss collect $700 from player (space 22);
12. TRUCK STOP #3: collect $1200 (space 23);
13. CHICKEN COOP #2: driver card pile gives instructions (space 26);
14. PUSH, PULL AND TOW: player pays you $40× roll of dice unless you elect to cut them a better deal (space 29);
15. TRUCK PAYMENT CENTER: player pays you $2000 per truck they have on the board (space 30);
16. TRUCK STOP #4: collect $1200 (space 32); 17. TIRE SERVICE: player pays you $20× roll of dice unless you elect to cut them a better deal (space 33);
18. NOVA FARMER MARKET: the fork lift driver damaged 2 skids of apples and loaded them anyways without the driver knowing. Collect damages of $550 (space 35);
19. DOT #3: DOT card pile tells all (space 36);

It should be noted that the information found in parenthesis is not found on the back or lower face of the respective holding card 46.

The Bank, the Banker, and the Game Bills

Figure 20A:
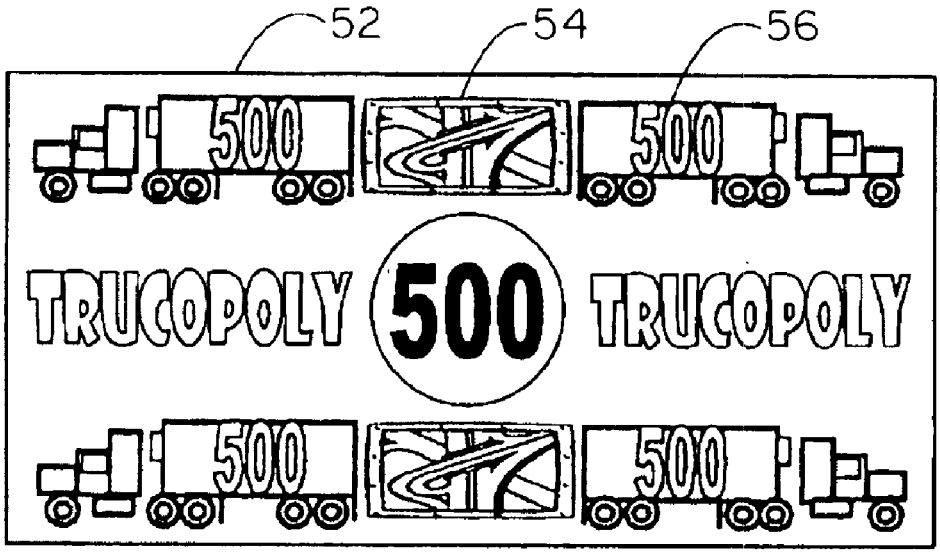
FIG. 20A illustrates the front view of a game bill representing money.
Figure 20B:
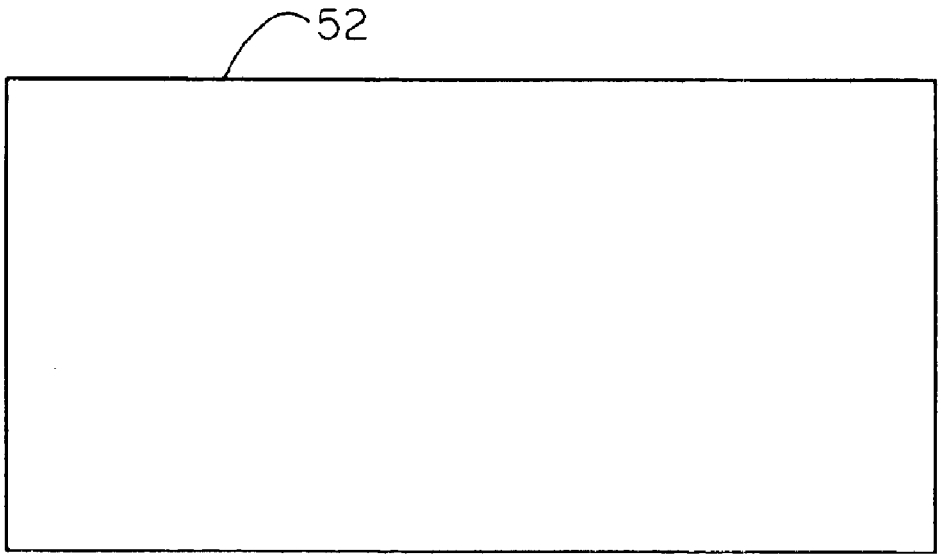
FIG. 20B illustrates the back view of a game bill representing money.

Any player may be designated as the banker for controlling the bank of money, as shown in FIGS. 20A and 20B. The bank of money includes at least the following game bills:

50 five dollar brown game bills;

40 ten dollar orange game bills;

40 twenty dollar yellow game bills;

40 fifty dollar red game bills;

40 one hundred dollar blue game bills;

40 five hundred dollar green game bills;

40 one thousand dollar pink game bills; and 40 five thousand dollar white game bills.

Accordingly, the total amount in the bank prior to the beginning of the game is about $267,450. Each of the game bills has the design as shown by game bill 52 in FIG. 20A except for the denomination. Each of the game bills has a blank back side, as shown in FIG. 20B. FIG. 20A shows indicia 54 of a highway interchange and indicia 56 of a semi-trailer truck.

Folding of the Game Board

Figure 21:
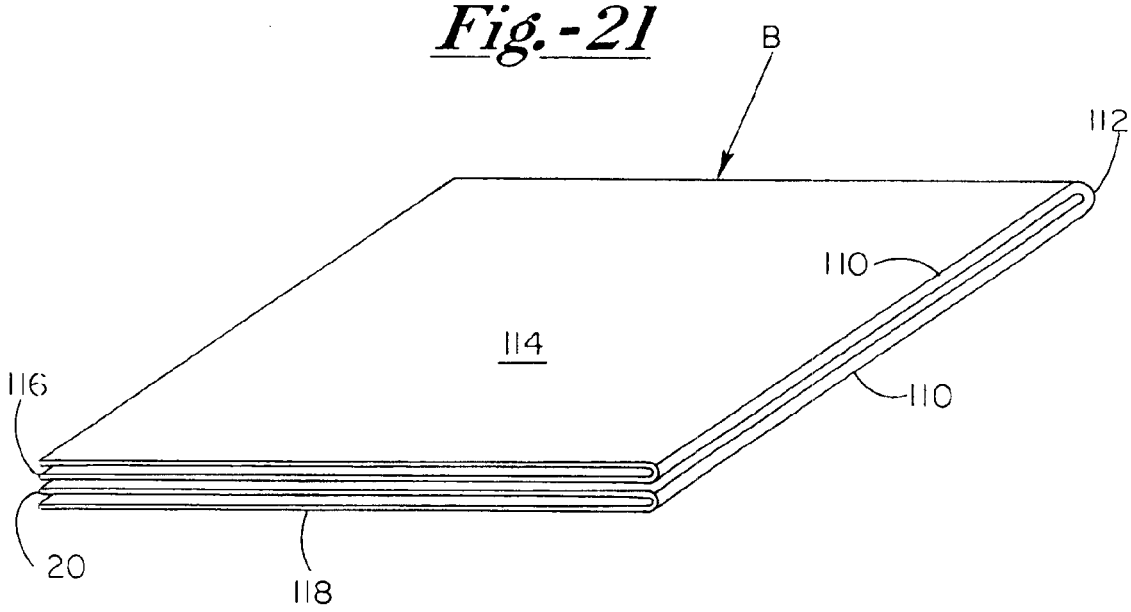
FIG. 21 shows a perspective view of the game board of FIG. 1 folded twice and reduced in size by one-fourth for storage in a game box.

The game board B may be folded between operating and storage configurations, as shown by FIGS. 1 and 21. FIG. 1 shows a folded out configuration. FIG. 21 shows a folded configuration. Such is provided for by laminating the board B or providing the board B to be a one piece plastic sheet, providing for a first fold line or weakened score portion along axis 110 and providing for a second fold line or weakened score portion along axis 112. Axis 110 and 112 run at right angles to each other. Axis 110 and 112 define four separate square plastic sheet sections 114, 116, 118 and 120 of the square board B. Each of the plastic sheet sections has four edges. In the folded configuration, game board B is flat. In the folded configuration, the plastic sheet or game board B is generally flat. In the folded configuration shown in FIG. 21, each of the plastic sheet sections confronts each of the other plastic sheet sections and the edges of the plastic sheet sections are aligned with respective edges of the other plastic sheet sections.

First Alternate Embodiment of Game Board

Figure 22:
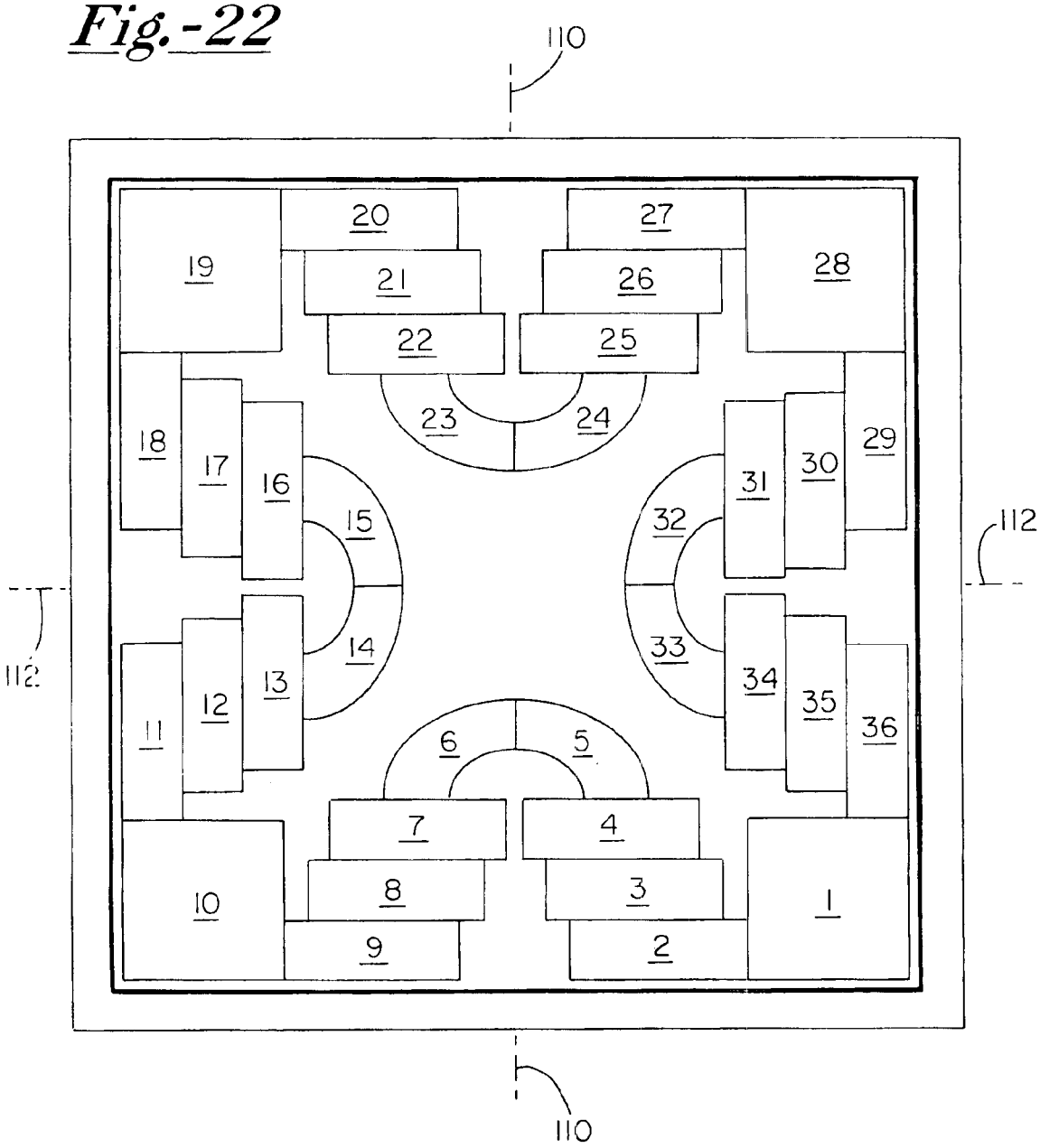
FIG. 22 is a top plan view of another embodiment of the game board.

FIG. 22 shows an alternate embodiment B' for a game board where spaces 1–36 are shaped and arranged as shown in FIG. 22. Like game board B, game board B' is formed of plastic or laminated. Like game board B, game board B' includes fold lines along axis 110 and 112 to be folded between a folded out (operating) configuration and a folded configuration for storage.

The Object of the Game

The object of the present game is to build a fleet of ten game trucks 40; the player first to have ten on the course is the winner. Such ends the game. A player may also win the game by default such as by where all of the other players go bankrupt. Such also ends the game.

Starting the Game

One player is designated to be the banker. The bank is the holding place for all money, property or holding cards 46, and game trucks 40.

Each of the players starts with $10,000 and one game truck 40 which is placed on space 1 without the player collecting $2500. The banker may distribute the bills as follows: one five-thousand dollar bill, three one-thousand dollar bills, three five-hundred dollar bills, three one-hundred dollar bills, two fifty dollar bills, three twenty dollar bills, three ten dollar bills, and two five dollar bills.

The order in which the players take their turns is determined by a roll of both die 44 by each of the players. The higher the roll, the higher the start position, with the highest start position being the first start. Ties are broken by another roll by each of the players who tied. When the starting positions are determined, the player who won the first start position then rolls the two die 44 and the two die 90 to start the game.

Method of Play

The method of playing the game is provided for by game board B including spaces 1–36, holding cards 46, DOT chance cards 48, DRIVER cards 50, the two die 44 and the two die 90. In other words, the method of playing the game is provided for in the directions found on such apparatus. In still other words, the method of playing the present game includes the following rules:

The object of the game is to build a fleet of ten trucks 40; the player doing so first, wins.

One player is designated to be the banker. The bank is the holding place for all money, property cards 46, and trucks 40.

Each player starts with $10,000 and 1 truck 40. The banker distributes the denominations as follows: 1–5,000 3–1,000's 3–500's 3–100's 2–50's 3–20's 3–10's 2–5's**

The player that rolls the highest starts the game, then 2nd highest and so on.

For each turn you must first roll all 4 dice 44 and 90, move your truck(s) 40, pay the fine(s) or purchase the space(s), then you can purchase another truck 40 assuming you roll two trucks 104 on the dice 90.

If you roll double numbers you get to take your turn and then roll again. If by chance you roll doubles for 3 consecutive rolls, you lose your turn and all your trucks 40 must go to the Home Office 10 for audit. You must pay the Insurance Fund $250 per truck; all at once, on your next turn to get them back into the game.

The skull dice 44 move your trucks 40 around the board. The skull 42 represents the number one, all other numbers are as stated. When you have only one truck 40 on the board B combine the total of the dice 44 and move that many spaces.

When you have more than one truck 40 on the board B you must move two trucks 40. One truck 40 per the number rolled on one dice 44, and the other truck 40 the number rolled on the second dice 44. If you roll one skull face 42, you must move one truck 40 back a space. If you roll two skulls 42, you must move two trucks 40 back one space each. (This backward movement does not apply when you have only one truck 40 on the board B).

You may buy only one truck 40 per turn when you roll two truck indicia 104, but only if the player has the $2500 in their possession. (Absolutely no loans from the bank or any other player!—You may sell any of your properties 46 to the bank to aid in the purchase of another truck 40.)

When you roll two red unhappy face indicia 106 you have crashed a truck 40. Pay $2500 into the Insurance Fund and your turn is over, but you keep your truck.

The money for the Insurance Fund is placed on the yellow and red letters T & R of the word TRUCOPOLY™ in the center of the board B.

When you roll two DOT indicia 108, or one of your trucks 40 lands on the Home Office 10 all your trucks 40 must go to the Home Office 10 for an audit. If it happens that you start a new trip, you do not get to collect the $2500 and your turn is over. On your next turn you must pay $250 per truck 40 to the Insurance Fund to get them back into circulation on the board B.

Every space with a price beneath it is available for sale for the stated price.

Once a player lands on a space that may be purchased, then they have the option to purchase it or not purchase it. Once purchased, any player that lands on the space must pay the fee listed on the holding card 46 to the owner of the space.

All spaces that can be purchased are free spaces to land on until purchased by a player, except for the IRS 9, Chicken Coops 8 and 26, DOT 4, 18 and 36, Truck Payments 30, and Truck Insurance 3.

When landing on the DOT (4, 18, 36) or Chicken Coop (8 and 26), the player must draw the respective card and do what the card says until the Chicken Coops and DOT spaces are sold. The money goes into the Insurance Fund, otherwise the money would go to the player that owns the space. Even if a player owns a DOT space or Chicken Coop, he or she is not above the law. They also must draw a card from either pile (the Driver card pile is for the Chicken Coops and the DOT card pile is for the DOT Inspection spaces) to see what their fate may be. If a player owns the space and gets fined; they would place the money into the Insurance Fund.

When landing on the IRS space 9; the money paid is $3000.00. The purchase price of this space is $8,000.00. If no player owns the IRS space, the money goes to the bank.

The Truck Payment 30 and Truck Insurance 3 money is also put into the bank until a player owns that space; in which case the player would collect money. Whenever a player lands on these spaces; he/she must pay the money due, times how many trucks you have on the board. Example: Five trucks 40 on the board B times $2,000 truck payment=$10,000. Five trucks 40 on the board B times $650 insurance payment=$3,250.

The Truck Stops 5, 14, 23, 32, Billy Big Rigger 16, Million Mile Shipping 21, Big Strapper Casino 22, Push Pull and Tow 29, GLS's Tire Service 33, Nova Market 35, and Mike's Large Car Service Center 2 spaces are all free spaces to land on until purchased. Once a player owns a space; anyone landing on that space must pay the fee that is stated on the holding card to the owner.

When landing on the No Truck Parking 7, Road Tax 11, Base Plate 20, Quarterly Fuel Tax 25, and Better Half 24 spaces, the money to be paid goes into the Insurance Fund.

If one of your trucks land on the DOT Audit Space 28; all of your trucks 40 must go to the Home Office 10 space. You must pay $250 per truck 40 to get them back in circulation on the board B.

In the event that a player lands on the DOT Audit space 28 or a space owned by another player and they owe more money than they have on hand; they may sell the bank a truck 40 or a holding card 46 for the price it was purchased. If the player does not own any holding cards 46 they must sell a truck 40 for $2500 to the bank. If the player selling the truck 40 only owns one truck 40, they are then out of the game. The holding cards 46 and trucks 40 may only be sold the bank. Once the bank has possession of the property, it is up for resale.

When landing on the REPO space 34, that lucky player may select any one player's truck 40 to repossess, granted the unlucky player has more than one truck 40 in the game.

On all other spaces you do and pay what the space says.

Once each trip around the board B is completed; you start another trip and collect $2500 except if you roll two DOT indicia 108.

When a player lands on the Insurance Crash Site space 19 they collect any money that is in the Insurance Fund.

It should be noted that the game apparatus may include stickers for certain game pieces to identify the game pieces as trucks and to identify which truck belongs to which player. There may be 4 strips containing 20 stickers. There may be 20 stickers for each color game piece or marker 40. There may be 10 of each color of game pieces 40; there is a sticker for each side. Example: There are 20 stickers of hearts, these 20 could cover both sides of the black game pieces 40.

Questions and Answers to Throw Light on the Method of Playing the Game

Q. What does the white dice 90 with a picture of a truck 104 mean?

A. Roll 2 Trucks 104 and this allows you to purchase another truck 40.

Q. What does the red unhappy face 106 on the white dice 90 mean?

A. Roll 2 red unhappy faces 106 on the white dice 90 and you have crashed a truck 40. You lose your turn and pay $2500 into the Insurance Fund.

Q. Where is the Insurance Fund located on the board B?

A. It is located on top of the TR letters of the word TRUCOPOLY™ on the game board B.

Q. What do the blue letters DOT 108 mean on the dice 90?

A. Roll two of the DOT 108 at the same time and all your trucks 40 go to the home office 10 for audit, and you lose your turn.

Q. How do I get my trucks 40 out of DOT home office audit 10?

A. On your next turn, you have to pay $250.00 per truck 40 to get them out.

Q. On some of the spaces on the board B, there is the word "price" and a dollar figure, what does this mean?

A. That is the purchase price, if a player wants to buy that space.

Q. On the space marked "Heads I win," do you need to flip a coin?

A. No! Just pay the other players $300.00 each.

Q. How do I collect the Insurance Fund money?

A. Land on the Accident crash site 19.

Q. Can one player own all 4 truck stops 5, 14, 23, and 32?

A. Yes.

Q. Do I collect $2500.00 every time I go around the board?

A. Yes, unless you have to go to home office 10 for an audit or a Chicken Coop card 50 or DOT card 48 says something else.

Q. Do I roll all four dice 44 and 90 at the same time?

A. YES.

Q. What does the REPO space 34 mean?

A. When landing on this space, you have the option of repossessing another player(s) truck 40 (one truck only) if they have more than one truck 40 on the board B. You also must pay $2500.00 to the bank when taking over another player(s) truck 40.

Q. What is the object of the game?

A. Who ever builds a fleet of ten trucks first wins and to have FUN!

Q. When I land on the Truck Payment space 30 or the Truck Insurance space 3, do I have to pay that dollar amount shown on the space times the total number of trucks 40 I have in play on the board B?

A. YES!

Q. Where does the money go from the No Parking Space 7?

A. Into the Insurance Fund.

Q. Before another player owns the Chicken Coop (spaces 26 or 62) or DOT spaces 4, 18 and 36, where does the money go?

A. Into the Insurance Fund.

Q. Before another player owns the IRS 9, Truck Payment 30, or Truck Insurance 3 spaces, where does this money go?

A. The bank.

Q. When I lose my turn, can I still buy another truck 40, sell a holding card 46, buy a space or advance any of my trucks 40 on the board B?

A. NO!

Q. What does DOT stand for?

A. Department of Transportation.

Q. What is a Chicken Coop?

A. Weigh Station.

Platform for Playing the Game

The platform for playing the game may be a board. Or the platform may be a processor, where the game is computer based and where the platform may include one or more of said processor, circuitry, software, monitor, or hard drive.

Second Alternate Embodiment of Game Board

Figure 24:
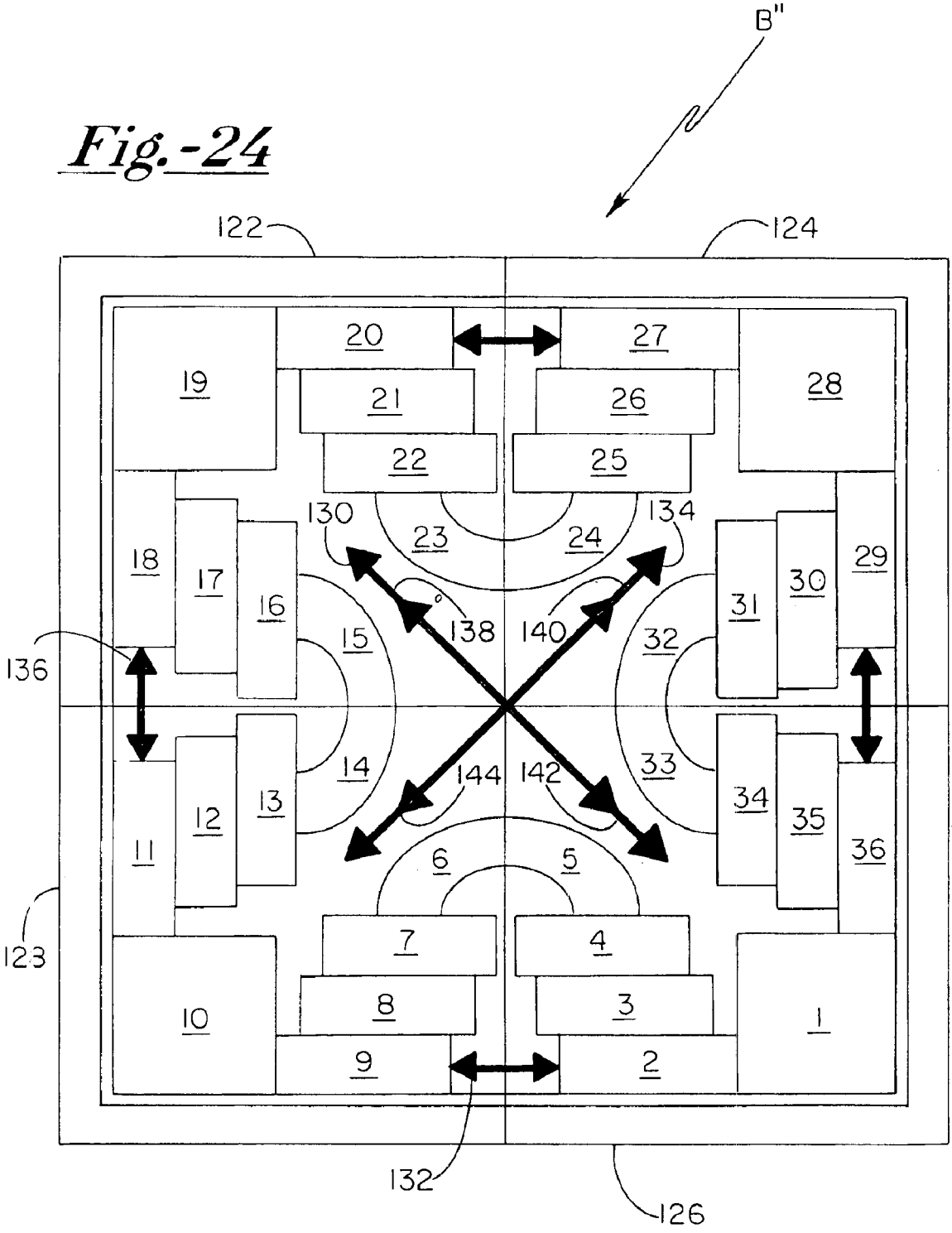
FIG. 24 is a top plan view of an alternate embodiment of the game board of the present invention.

As shown in FIG. 24, an interlocking game board B" may be formed of wood, plastic, cardboard or rubber where the thickness of the game board B" is generally the same thickness of a conventional jigsaw puzzle. This is in contrast to the thickness of the relatively thin game board B and the relatively thin game board B', both of which have the thickness of several sheets of conventional paper such as newspaper. Game board B" has the layout of spaces 1–36 as the layout of game board B'.

Game board B" is generally square from a top plan view and includes four generally square sections 122, 124, 126 and 128. The four generally square sections 122, 124, 126 and 128 are interlocked by a first central key 130 and by four peripheral keys 132. Each of the keys 130 and 132 is removable from the game board B" such that, when removed, the four sections 122, 124, 126 and 128 can be stacked on top of each other and easily stored in a compact fashion in a parallelepiped cardboard game box.

Central key 130 cooperates with an identically shaped central key receptacle 134 formed in game board B" and each of the peripheral keys 132 cooperates with an identically shaped key receptacle 136 formed in game board B". Each of the receptacles 134 and 136 may be through openings that extend completely through the game board B" or each of the key receptacles 134 and 136 may extend only partially into the thickness of the game board B" such as to be channeled therein.

Key 130 has four portions or prongs 138, 140, 142 and 144. Each of the portions 138, 140, 142, and 144 may be identically shaped (as shown in FIG. 24) or may be of a different shape such as in a jigsaw puzzle. If of a different shape, then the four sections 122, 124, 126 and 128 may fit together in only one orientation, with the order of spaces 1–36 being 1 to 36. However, where the key portions 138, 140, 142 and 144 are identically shaped, and where the peripheral keys 132 are identically shaped, then the order of spaces 1–36 may be rearranged, which may be preferred, but with the game trucks 40 still moving from adjacent space to adjacent space. For example, board sections 122 and 128 may be switched such that game trucks 40 must move from spaces 1–5 to spaces 15–23 to spaces 6–14 to spaces 24–32 to spaces 33 to 1, where the key portions 138, 130, 142 and 144 are identically shaped and where the peripheral key portions 132 are identically shaped.

Keys 130 and 132, like game board B", may also formed of wood, plastic, cardboard or rubber and are preferably formed of the same material as game board B".

What is claimed is:

1. A method for playing a trucking game, wherein the trucking game includes a course having a number of spaces, game trucks for moving along said course, an initial amount of money for each player of a set of players, wherein the method comprises the steps of:

taking money away from a player by providing a direction in at least one space for taking money away from a player;

having a player receive money by providing a direction in at least one space for reception of money by a player;

having a player operate a chance element having a first operator for determining how many spaces said game trucks move and a second operator for determining how many game trucks a player may purchase;

having a player be provided with an opportunity to purchase a purchasable space when a game truck lands on said purchasable space; and having a player win the game by placing a set of game trucks of a predefined number on said course such that the game is won by building a fleet of trucks.

2. The method of claim 1 and further comprising the steps of taking a game truck away from a player and awarding said game truck to another player by providing a direction in at least one space for said taking of said game truck.

3. The method of claim 1 and further comprising the steps of:

a) having a player draw a card from a first set of cards by providing a direction in at least one space; and b) having said player follow a direction on said card from said first set of cards and providing at least some the cards of the first set of cards to have directions for responding to transportation authorities.

4. The method of claim 1 and further comprising the steps of:

a) having a player draw a card from a second set of cards by providing a direction in at least one space; and b) having said player follow a direction on said card from said second set of cards and providing at least some of the cards of the second set of cards to have directions for responding to situations caused by a driver.

5. The method of claim 1 wherein the step of having a player operate a chance element comprises the steps of providing a third operator for said chance element for determining whether a truck has crashed and providing a course of action in response to whether said truck has crashed, and having said player operate said chance element having the third operator.

6. The method of claim 1 wherein the step of having a player operate a chance element comprises the steps of providing a fourth operator for said chance element for determining whether a safety check must be made, and having said player operate said chance element having the fourth operator.

7. The method of claim 1 wherein the step of having a player operate a chance element comprises the steps of providing a fifth operator for said chance element for determining whether a game truck moves backwardly along said course, and having said player operate said chance element having said fifth operator.

8. The method of claim 1 and further comprising the step of selecting said purchasable space to represent a service center.

9. The method of claim 1 and further comprising the step of selecting said purchasable space to represent a truck insurance company.

10. The method of claim 1 and further comprising the step of selecting said purchasable space to represent a department of transportation.

11. The method of claim 1 and further comprising the step of selecting said purchasable space to represent a truck stop having a restaurant.

12. The method of claim 1 and further comprising the step of selecting said purchasable space to represent a weigh station.

13. The method of claim 1 and further comprising the step of selecting said purchasable space to represent the internal revenue service.

14. The method of claim 1 and further comprising the step of selecting said purchasable space to represent a produce broker.

15. The method of claim 1 and further comprising the step of selecting said purchasable space to represent a shipper.

16. The method of claim 1 and further comprising the step of selecting said purchasable space to represent a casino.

17. The method of claim 1 and further comprising the step of selecting said purchasable space to represent a tow service.

18. The method of claim 1 and further comprising the step of selecting said purchasable space to represent a truck payment center.

19. The method of claim 1 and further comprising the step of selecting said purchasable space to represent a tire service.

20. The method of claim 1 and further comprising the step of selecting said purchasable space to represent a farmers' market.

21. The method of claim 1 and further comprising the steps of providing a third set of cards, associating each of the cards of the third set with one of said purchasable spaces that may be purchased, and giving the card associated with said purchasable space to the player who purchased said purchasable space.

22. The method of claim 1 wherein the step of having a player receive money comprises the step of having said player collect a predefined amount of money as a game truck lands on or passes over said space.

23. The method of claim 1 wherein the step of having a player receive money comprises the step of awarding money to a player for a pallet refund.

24. The method of claim 1 wherein the step of taking money away from a player comprises the step of fining a player for a no truck parking violation.

25. The method of claim 1 wherein the step of taking money away from a player comprises the step of fining a player for a poor safety rating.

26. The method of claim 1 wherein the step of taking money away from a player comprises the step of fining a player in response to a truck audit.

27. The method of claim 1 wherein the step of taking money away from a player comprises the step of paying road tax.

28. The method of claim 1 wherein the step of having a player receive money comprises the step of collecting inheritance.

29. The method of claim 1 wherein the step of having a player receive money comprises the step of collecting money for an overshipment.

30. The method of claim 1 wherein the step of taking money away from a player comprises the step of paying a predefined amount of money to each of the other players.

31. The method of claim 1 wherein the step of having a player receive money comprises the step of collecting money from an insurance fund.

32. The method of claim 1 wherein the step of having a player receive money comprises the step of collecting money in response to an accident.

33. The method of claim 1 wherein the step of taking money away from a player comprises the step of making a quarterly insurance payment.

34. The method of claim 1 wherein the step of taking money away from a player comprises the step of sending money home.

35. The method of claim 1 wherein the step of taking money away from a player comprises the step of paying a fuel tax.

36. The method of claim 1 wherein the step of having a player receive money comprises the step of collecting a health insurance refund.

37. A method for playing a trucking game, wherein the trucking game includes a course having a number of spaces, game trucks for moving along said course, an initial amount of money for each player of a set of players, wherein the method comprises the steps of:

taking money away from a player by providing a direction in at least one space for taking money away from a player;

having a player receive money by providing a direction in at least one space for reception of money by a player;

having a player operate a chance element having a first operator for determining how many spaces said game trucks move and a second operator for determining how many game trucks a player may purchase;

taking a game truck away from a player and awarding said game truck to another player by providing a direction in at least one space for said taking of said game truck; and having a player win the game by placing a set of game trucks of a predefined number on said course such that the game is won by building a fleet of trucks.

38. A method for playing a trucking game, wherein the trucking game includes game trucks for moving along a course and an initial amount of money for each player of a set of players, wherein the method comprises the steps of:

a) taking money away from a player by providing a direction for taking money away from a player, with the step of taking money away from a player comprising the steps of:

i) fining a player for a no truck parking violation;

ii) fining a player for a poor safety rating:

iii) fining a player in response to a truck audit;

iv) having a player make an insurance payment; and v) having a player pay a fuel tax;

b) having a player receive money by providing a direction for reception of money by a player;

c) having a player win the game by building a fleet of trucks;

d) having a player follow a diretion for responding to transportation authorities;

e) having a player follow a direction for responding to situations caused by a driver;

f) having a player operate a chance element for determining whether a truck has crashed;

g) optionally having a player be provided with an opportunity to purchase real estate; and h) optionally taking a game truck away from a player.

* * * * *